US008967038B2

(12) United States Patent
Rivera

(10) Patent No.: US 8,967,038 B2
(45) Date of Patent: Mar. 3, 2015

(54) CARTRIDGE FOR USE IN COFFEE MAKER

(71) Applicant: Adrian Rivera, Whittier, CA (US)

(72) Inventor: Adrian Rivera, Whittier, CA (US)

( * ) Notice: Subject to any disclaimer, the term of this patent is extended or adjusted under 35 U.S.C. 154(b) by 0 days.

(21) Appl. No.: 13/757,026

(22) Filed: Feb. 1, 2013

(65) Prior Publication Data

US 2013/0139699 A1 Jun. 6, 2013

(51) Int. Cl.
*A47J 31/06* (2006.01)
*B65D 85/804* (2006.01)

(52) U.S. Cl.
CPC ..... *B65D 85/8043* (2013.01)
USPC ..... 99/295

(58) Field of Classification Search
CPC ..... B65D 2565/385; B65D 85/8043
USPC ..... 99/279, 286, 287, 289 R, 290, 295, 300, 99/302 P, 302 R, 304, 306, 307, 316, 317, 99/323, 312, 314, 315, 321, 322; 426/77, 426/78, 79, 80, 81, 82, 394, 431, 433, 435, 426/473, 477, 478, 479
See application file for complete search history.

(56) References Cited

U.S. PATENT DOCUMENTS

| | | | | |
|---|---|---|---|---|
| 2,433,815 | A | | 12/1947 | Laforge |
| 3,115,822 | A | | 12/1963 | Totten |
| 3,120,170 | A | | 2/1964 | Garte |
| 3,136,241 | A | | 6/1964 | Price |
| 3,199,682 | A | | 8/1965 | Scholtz |
| 3,384,004 | A | | 5/1968 | Perlman et al. |
| 3,583,308 | A | | 6/1971 | Williams |
| 3,607,297 | A | | 9/1971 | Fasano |
| 3,844,206 | A | | 10/1974 | Weber |
| 4,253,385 | A | | 3/1981 | Illy |
| 4,286,515 | A | | 9/1981 | Baumann et al. |
| 5,123,335 | A | | 6/1992 | Aselu |
| 5,233,914 | A | | 8/1993 | English |
| 5,325,765 | A | | 7/1994 | Sylvan et al. |
| 5,335,589 | A | | 8/1994 | Yerves et al. |
| 5,526,733 | A | | 6/1996 | Klawuhn et al. |
| 5,582,730 | A | | 12/1996 | Hugentobler |
| 5,676,041 | A | | 10/1997 | Glucksman et al. |
| 5,829,340 | A | | 11/1998 | Yang |
| 5,840,189 | A | * | 11/1998 | Sylvan et al. ..... 210/474 |
| 5,870,943 | A | | 2/1999 | Levi et al. |
| 5,906,845 | A | * | 5/1999 | Robertson ..... 426/80 |

(Continued)

FOREIGN PATENT DOCUMENTS

WO WO 2005/092160 A1 10/2005

*Primary Examiner* — Tu B Hoang
*Assistant Examiner* — Joseph Iskra
(74) *Attorney, Agent, or Firm* — Kenneth L. Green

(57) ABSTRACT

A brewing cartridge containing a filter containing brewing material and configured to reside generally horizontally in a coffee maker. The filter has a top rim sandwiched between a coffee holder cover and a coffee holder base, and the cartridge may be disassembled after use to recycle and/or reuse components thereof, the rim facilitating removing the filter and brewing material from the used cartridge. The coffee maker includes a reservoir, a pump, a heater, and a nozzle for injecting heated water into the cartridge. The cartridge receives the heated water through the coffee holder cover and releases brewed liquid through a passage on a side of the cartridge. The cover may be a plastic cover or a foil cover, and the filter may be provided to a consumer as an empty filter for filling by the consumer, or as a pre-packed filter containing brewing material.

22 Claims, 34 Drawing Sheets

(56) References Cited

U.S. PATENT DOCUMENTS

| | | | | |
|---|---|---|---|---|
| 6,136,352 | A | 10/2000 | Silverstein et al. | |
| 6,189,438 | B1 | 2/2001 | Bielfeldt et al. | |
| D454,433 | S | 3/2002 | Peter | |
| D454,434 | S | 3/2002 | McDaniel et al. | |
| 6,440,256 | B1 | 8/2002 | Gordon et al. | |
| D474,110 | S | 5/2003 | Sweeney | |
| D474,111 | S | 5/2003 | Lazaris | |
| 6,589,577 | B2 | 7/2003 | Lazaris et al. | |
| 6,606,938 | B2 | 8/2003 | Taylor | |
| 6,607,762 | B2 * | 8/2003 | Lazaris et al. | 426/79 |
| 6,645,537 | B2 | 11/2003 | Sweeney et al. | |
| 6,655,260 | B2 | 12/2003 | Lazaris et al. | |
| 6,658,989 | B2 * | 12/2003 | Sweeney et al. | 99/315 |
| 6,708,600 | B2 | 3/2004 | Winkler et al. | |
| 6,740,345 | B2 | 5/2004 | Cai | |
| 6,832,542 | B2 | 12/2004 | Hu et al. | |
| 6,843,165 | B2 | 1/2005 | Stoner et al. | |
| D502,362 | S | 3/2005 | Lazaris et al. | |
| 6,904,840 | B1 | 6/2005 | Pfeifer et al. | |
| 6,948,420 | B2 | 9/2005 | Kirschner et al. | |
| 7,047,870 | B2 | 5/2006 | Gantt et al. | |
| 7,081,263 | B2 | 7/2006 | Albrecht | |
| 7,131,369 | B2 | 11/2006 | Gantt et al. | |
| 7,320,274 | B2 | 1/2008 | Castellani | |
| 7,946,217 | B2 | 5/2011 | Favre et al. | |
| 8,047,127 | B2 | 11/2011 | Lin | |
| 2002/0148356 | A1 | 10/2002 | Lazaris et al. | |
| 2004/0118290 | A1 | 6/2004 | Cai | |
| 2006/0159815 | A1 | 7/2006 | Crook et al. | |
| 2006/0174769 | A1 | 8/2006 | Favre et al. | |
| 2006/0196364 | A1 | 9/2006 | Kirschner | |
| 2009/0229471 | A1 | 9/2009 | Lun et al. | |
| 2010/0083843 | A1 | 4/2010 | Denisart et al. | |

* cited by examiner

CARTRIDGE FOR USE IN COFFEE MAKER

CROSS-REFERENCE TO RELATED APPLICATIONS

The present application is a Continuation in Part of:

U.S. patent application Ser. No. 11/777,831 filed 13 Jul. 2007;

U.S. patent application Ser. No. 12/610,181 filed 30 Oct. 2009;

U.S. patent application Ser. No. 12/620,584 filed 17 Nov. 2009;

U.S. patent application Ser. No. 12/762,262 filed 16 Apr. 2010;

U.S. patent application Ser. No. 12/960,496 filed 4 Dec. 2010; and

U.S. patent application Ser. No. 13/235,367 filed 17 Sep. 2011, which applications are incorporated in their entirety herein by reference.

BACKGROUND OF THE INVENTION

The present invention relates to brewing cartridges and in particular to a brewing cartridge which may be disassembled and parts thereof recycled and/or reused.

U.S. Pat. Nos. 5,325,765 and 5,840,189 disclose features of a brewing cartridge sold under the trademark K-CUP, and U.S. Pat. Nos. 6,606,938, 6,708,600, and 7,165,488 disclose features of coffee makers sold under the trademark KEURIG. While the KEURIG coffee makers and K-CUP cartridges have met with tremendous success, some consumers desire a lower cost cartridge which can be used in the same manner as the K-CUP cartridge in the KEURIG coffee maker. In particular, there is a need for a cartridge which allows easy removal of a cartridge lid or cover to re-use and/or recycle portion of the cartridge. The '765, '189, '938, 600, and '488 patents are herein incorporated by reference in their entirety.

Unfortunately, The KEURIG coffee maker described in U.S. Pat. No. 7,165,488 and the K_CUP cartridge described in U.S. Pat. No. 5,325,765 present unique problems for a reusable adapter. FIG. 6 of the '488 patent shows an inlet probe 28 which punctures the top of the K-CUP cartridge and injects heated water into the cartridge. FIG. 7 of the '488 patent shows an offset outlet probe 30 which punctures the base of the K-CUP cartridge and enters an empty portion of the cartridge interior to receive and carry the brewed drink for disbursing to a cup. The function of the KEURIG coffee maker presents a particular problem to designing an adapter because of the presence of the outlet probe to puncture the cartridge and carry the brewed drink from the cartridge. To retain the intended function of the KEURIG coffee maker, a reusable adapter would have to align with and seal around the offset outlet probe. Such a design would require both close tolerances and sealing features. Any miss-alignment could result in damage to the expensive KEURIG coffee maker, and a failure to seal would appear to create a mess for the consumer.

Further discouraging any new adapter design, Keurig offers an adapter sold under the trademark MY K-CUP. The MY K-CUP adapter does not replace a K-CUP cartridge, but instead requires the removal of a K-CUP Pack Holder before insertion of the MY K-CUP into the coffee maker. The outlet probe is part of the K-CUP Pack Holder and is removed with the K-CUP Pack Holder. The MY K-CUP adapter and the procedure for installing the MY K-CUP adapter into the KEURIG coffee maker, is a significant discouragement to attempting to develop a drop in adapter as a direct replacement for the K-CUP cartridge because it shows that Keurig did not believe that a drop in adapter was a viable product, probably because of the role of the outlet probe in the coffee maker design.

U.S. patent application Ser. No. 11/777,831 filed Jul. 13, 2007 for "Pod Adapter System for Single Service Beverage Brewers" by the present applicant overcame the difficulties presented by the K-CUP cartridge and KEURIG coffee maker by inventing an adapter which fits into the K-CUP envelope but alters the fundamental operation of the KEURIG coffee maker. Through investigation of the KEURIG coffee maker and experimentation, the Applicant discovered the unexpected result, that if the brewed drink is released into the area of the KEURIG coffee maker under the K-CUP, the brewed drink would consistently flow into a cup positioned for normal use of the KEURIG coffee maker.

The '831 application discloses packaging the coffee in closed filter paper commonly called a pod, and inserting the closed pod into a holder base and attaching a lid (or cover) to the base to complete a cartridge. The holder base includes structure to avoid the offset outlet probe and an opening allowing brewed drink to escape from the cartridge. Following preparing a brewed beverage, the cover may be removed from the base and the pod removed from the base, allowing the pod to be recycled and the base and/or cover to be independently reused and/or recycled. The adapter of the '831 patent application thus provides a useful alternative to the K-CUP cartridge. The '831 patent application is incorporated by reference above.

U.S. patent application Ser. No. 12/610,181 filed 30 Oct. 2009 for "Coffee maker" filed by the present applicant discloses an adapter receiving filter paper formed into a cup and having a rim captured between the adapter base and cover, but not attached by adhesive or other means to the adapter base. Such capturing of the rim both holds the filter paper, and brewing material held in the filter paper, against the cover facilitating compete brewing, and also allowed easier extraction of the filter paper and brewing material for recycling, and recycling and/or reuse of the adapter base and/or cover. The '181 further discloses a horizontal disposition of the cartridge in the coffee maker, but does not disclose all embodiments of such horizontally disposed cartridge. The '181 patent application is incorporated by reference above.

BRIEF SUMMARY OF THE INVENTION

The present invention addresses the above and other needs by providing a brewing cartridge containing a filter containing brewing material and configured to reside generally horizontally in a coffee maker. In one embodiment the filter has a top rim sandwiched between a coffee holder cover and a coffee holder base, residing against the coffee holder base but not adhered to the coffee holder base, and the cartridge may be disassembled after use to recycle and/or reuse components thereof, the rim facilitating removing the filter and brewing material from the coffee holder base. The coffee maker includes a reservoir, a pump, a heater, and a nozzle for injecting heated water into the cartridge. The cartridge receives the heated water through the coffee holder cover and releases brewed liquid through a passage on a side of the cartridge. The cover may be a plastic cover or a foil cover, and the filter may be provided to a consumer as an empty filter for filling by the consumer, or as a pre-packed filter containing brewing material.

In accordance with one aspect of the invention, there is provided a brewing material cartridge which may be assembled and disassembled by a consumer. A cover (or lid)

may be detached from a holder base after use, and the holder base may be cleaned and reused, or recycled after use.

In accordance with another aspect of the invention, there is provided a brewing material cartridge containing a filter having a rim sandwiched between a holder base and a cover. Such sandwiching positions and holds the filter in a correct position for brewing a drink, and facilitates easy removal of the filter and brewing material after use.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 52B shows a top view of the fourth embodiment of the filter paper cup containing brewing material configured for a horizontal residing coffee holder.

FIG. 52C shows a bottom view of the fourth embodiment of the filter paper cup containing brewing material configured for a horizontal residing coffee holder.

FIG. 52D is a cross-sectional view of the fourth embodiment of the filter paper cup containing brewing material configured for a horizontal residing coffee holder taken along line 52D-52D of FIG. 52B, according to the present invention.

FIG. 53A shows a side view of a peel-off strip according to the present invention.

FIG. 53B shows a top view of the peel-off strip according to the present invention.

FIG. 54A shows a side view of a peel-off packaging according to the present invention.

FIG. 54B shows a top view of the peel-off packaging according to the present invention.

FIG. 55A shows a cross-sectional view of the coffee holder base and the fourth filter paper cup containing brewing material, according to the present invention.

FIG. 55B shows a cross-sectional view of the coffee holder base and the fourth filter paper cup containing brewing material residing in the coffee holder, according to the present invention.

FIG. 55C shows a cross-sectional view of an assembled cartridge configured to reside horizontally in a coffee maker, according to the present invention.

FIG. 56 shows a rimmed mesh brewing material holder according to the present invention.

FIG. 57A shows a cross-sectional view of the coffee holder base, the rimmed mesh brewing material holder, brewing material, and a holder lid according to the present invention.

Figure 57A:
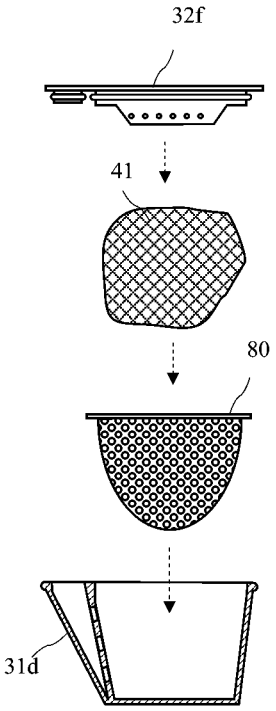
Figure 57B:
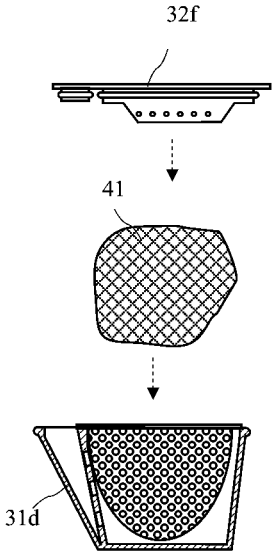

FIG. 57B shows a cross-sectional view of the mesh brewing material holder residing in the coffee holder base, according to the present invention.

Figure 57C:
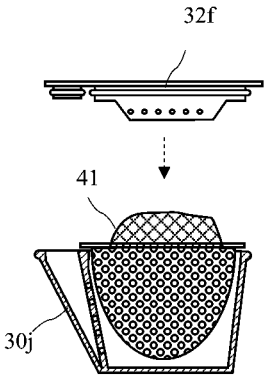

FIG. 57C shows a cross-sectional view of the brewing material residing in the mesh brewing material holder residing in the coffee holder base, according to the present invention.

Figure 57D:
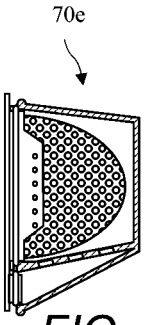

FIG. 57D shows a cross-sectional view of an assembled cartridge configured to reside horizontally in a coffee maker, according to the present invention.

Figure 58B:
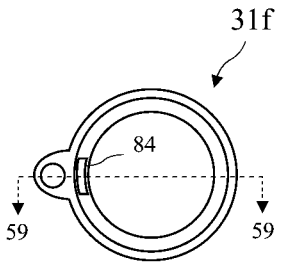
Figure 58A:
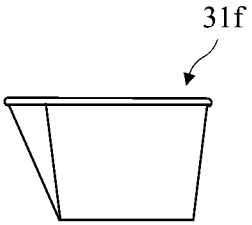

FIG. 58A shows a side view of a sixth embodiment of a coffee holder base configured to reside horizontally in a coffee maker, according to the present invention.

FIG. 58B shows a top view of the sixth coffee holder base configured to reside horizontally in a coffee maker, according to the present invention.

Figure 58C:
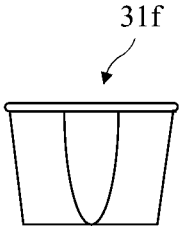

FIG. 58C shows a front view of the sixth coffee holder base configured to reside horizontally in a coffee maker, according to the present invention.

Figure 59:
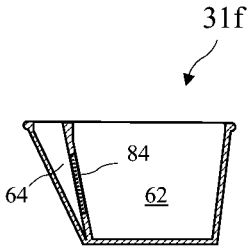

FIG. 59 shows a cross-sectional view of the sixth coffee holder base configured to reside horizontally in a coffee maker, according to the present invention taken along line 59-59 of FIG. 58B.

Figure 60A:
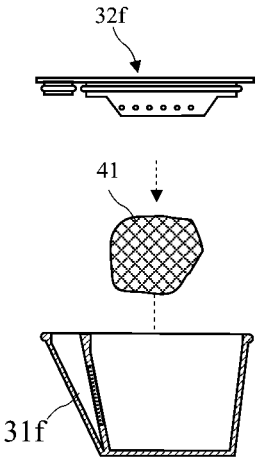

FIG. 60A shows a cross-sectional view of the twelfth coffee holder, the sixth coffee holder lid, and brewing material, according to the present invention.

Figure 60B:
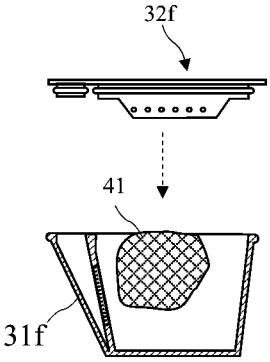

FIG. 60B shows a cross-sectional view of the sixth coffee holder base, the sixth coffee holder lid, and brewing material residing in the coffee holder, according to the present invention.

Figure 60C:
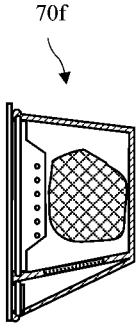

FIG. 60C shows a cross-sectional view of an assembled cartridge configured to reside horizontally in a coffee maker, according to the present invention.

Figure 61B:
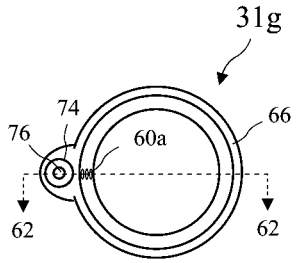
Figure 61A:
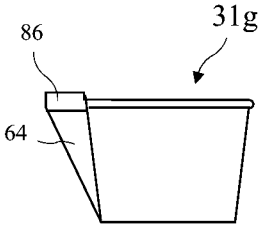

FIG. 61A shows a side view of a seventh embodiment of a coffee holder base configured to reside horizontally in a coffee maker, according to the present invention.

FIG. 61B shows a top view of the seventh coffee holder base configured to reside horizontally in a coffee maker, according to the present invention.

Figure 61C:
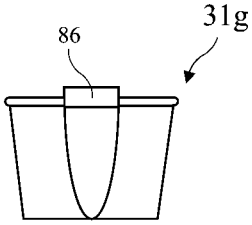

FIG. 61C shows a front view of the seventh coffee holder base configured to reside horizontally in a coffee maker, according to the present invention.

Figure 62:
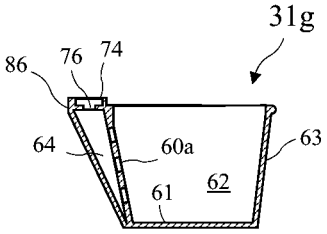

FIG. 62 shows a cross-sectional view of the seventh coffee holder base configured to reside horizontally in a coffee maker, according to the present invention taken along line 62-62 of FIG. 61B.

Figure 63B:
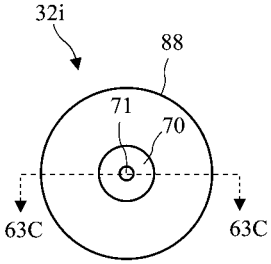
Figure 63A:
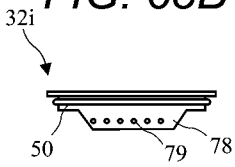

FIG. 63A shows a side view of a ninth embodiment of a coffee holder lid for the thirteenth coffee holder configured to reside horizontally in a coffee maker, according to the present invention.

FIG. 63B shows a top view of the ninth coffee holder lid for the seventh coffee holder base configured to reside horizontally in a coffee maker, according to the present invention.

Figure 63C:
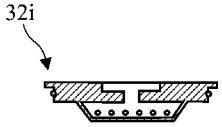

FIG. 63C is a cross-sectional view of the ninth coffee holder lid for the thirteenth coffee holder configured to reside horizontally in a coffee maker, taken along line 63C-63C of FIG. 62B, according to the present invention.

Figure 64A:
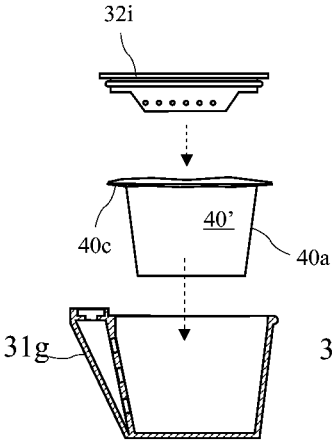

FIG. 64A shows a cross-sectional view of the seventh coffee holder base, the ninth coffee holder lid, and a filter paper cup containing brewing material, according to the present invention.

Figure 64B:
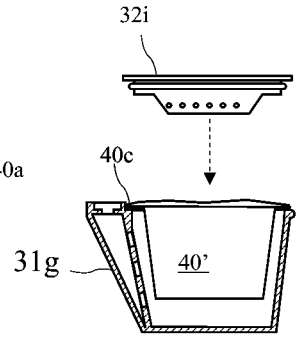

FIG. 64B shows a cross-sectional view of the seventh coffee holder base, the ninth coffee holder lid, and a filter paper cup containing brewing material residing in the coffee holder, according to the present invention.

Figure 64C:
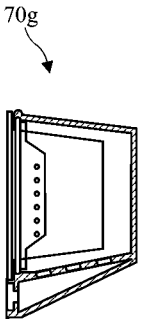

FIG. 64C shows a cross-sectional view of an assembled cartridge configured to reside horizontally in a coffee maker, according to the present invention.

Figure 65B:
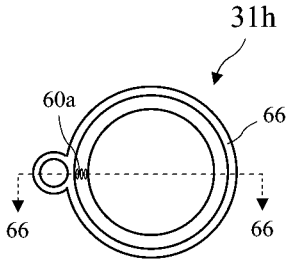
Figure 65A:
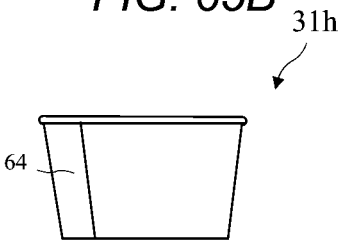

FIG. 65A shows a side view of an eighth embodiment of a coffee holder base configured to reside horizontally in a coffee maker, according to the present invention.

FIG. 65B shows a top view of the eighth coffee holder base configured to reside horizontally in a coffee maker, according to the present invention.

Figure 65C:
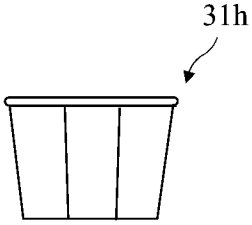

FIG. 65C shows a front view of the eighth coffee holder base configured to reside horizontally in a coffee maker, according to the present invention.

Figure 66:
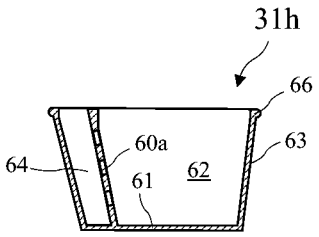

FIG. 66 shows a cross-sectional view of the eighth coffee holder base configured to reside horizontally in a coffee maker, according to the present invention taken along line 66-66 of FIG. 65B.

Figure 67B:
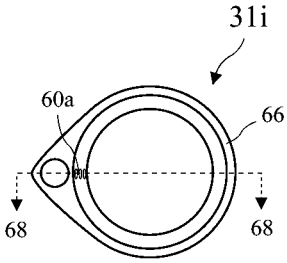
Figure 67A:
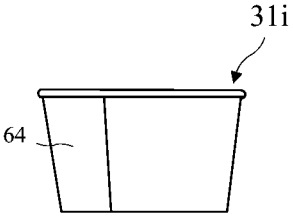

FIG. 67A shows a side view of a ninth embodiment of a coffee holder base configured to reside horizontally in a coffee maker, according to the present invention.

FIG. 67B shows a top view of the ninth coffee holder base configured to reside horizontally in a coffee maker, according to the present invention.

Figure 67C:
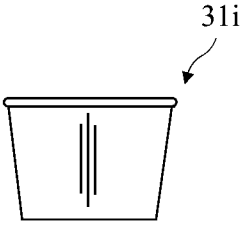

FIG. 67C shows a front view of the ninth coffee holder base configured to reside horizontally in a coffee maker, according to the present invention.

Figure 68:
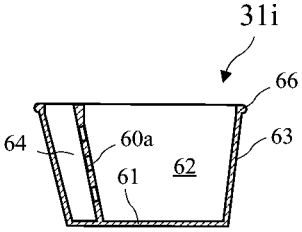

FIG. 68 shows a cross-sectional view of the ninth coffee holder base configured to reside horizontally in a coffee maker, according to the present invention taken along line 68-68 of FIG. 67B.

Figure 69B:
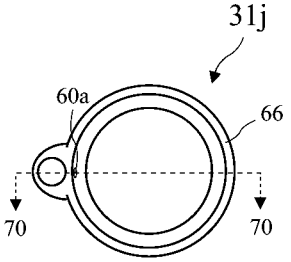
Figure 69A:
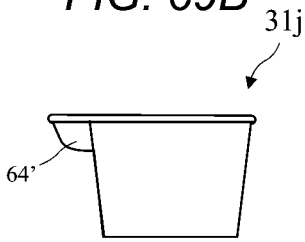

FIG. 69A shows a side view of a tenth embodiment of a coffee holder base configured to reside horizontally in a coffee maker, according to the present invention.

FIG. 69B shows a top view of the tenth coffee holder base configured to reside horizontally in a coffee maker, according to the present invention.

Figure 69C:
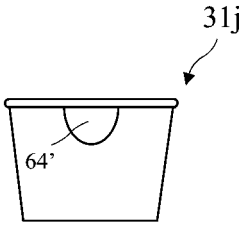

FIG. 69C shows a front view of the tenth coffee holder base configured to reside horizontally in a coffee maker, according to the present invention.

Figure 70:
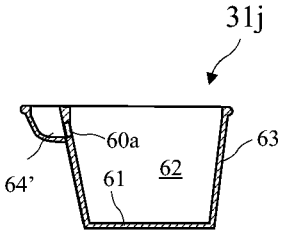

FIG. 70 shows a cross-sectional view of the tenth coffee holder base configured to reside horizontally in a coffee maker, according to the present invention taken along line 70-70 of FIG. 69B.

Figure 71:
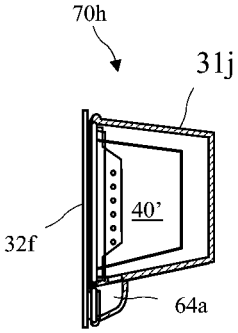

FIG. 71 is a cross-sectional view of an assembled cartridge including the tenth coffee holder base configured to reside horizontally in a coffee maker, according to the present invention.

Figure 72B:
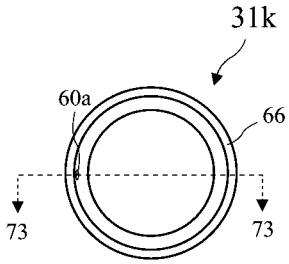
Figure 72A:
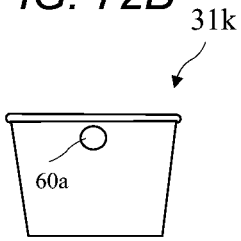

FIG. 72A shows a side view of an eleventh embodiment of a coffee holder base configured to reside horizontally in a coffee maker, according to the present invention.

FIG. 72B shows a top view of the eleventh coffee holder base configured to reside horizontally in a coffee maker, according to the present invention.

Figure 72C:
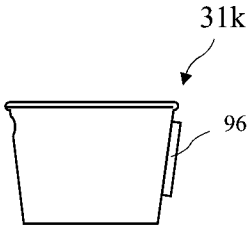

FIG. 72C shows a front view of the eleventh coffee holder base configured to reside horizontally in a coffee maker, according to the present invention.

Figure 73:
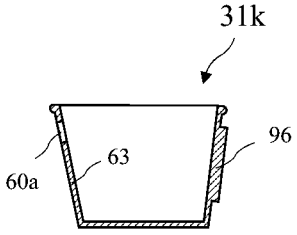

FIG. 73 shows a cross-sectional view of the eleventh coffee holder base configured to reside horizontally in a coffee maker, according to the present invention taken along line 72-72 of FIG. 72B.

Figure 74:
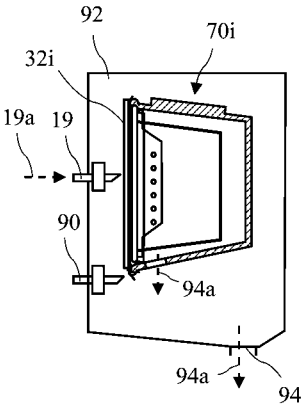

FIG. 74 is a cross-sectional view of an assembled cartridge including the eleventh coffee holder base configured to reside horizontally in a coffee maker, according to the present invention.

Figure 75B:
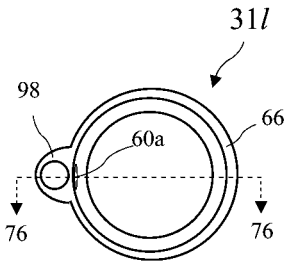
Figure 75A:
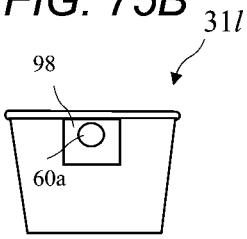

FIG. 75A shows a side view of a twelfth embodiment of a coffee holder base configured to reside horizontally in a coffee maker, according to the present invention.

FIG. 75B shows a top view of the twelfth coffee holder base configured to reside horizontally in a coffee maker, according to the present invention.

Figure 75C:
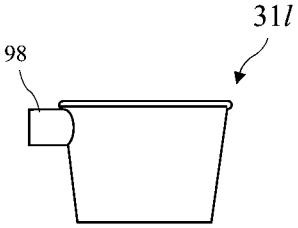

FIG. 75C shows a front view of the twelfth coffee holder base configured to reside horizontally in a coffee maker, according to the present invention.

Figure 76:
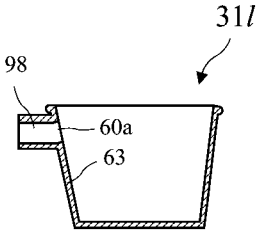

FIG. 76 shows a cross-sectional view of the twelfth coffee holder base configured to reside horizontally in a coffee maker, according to the present invention taken along line 72-72 of FIG. 72B.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
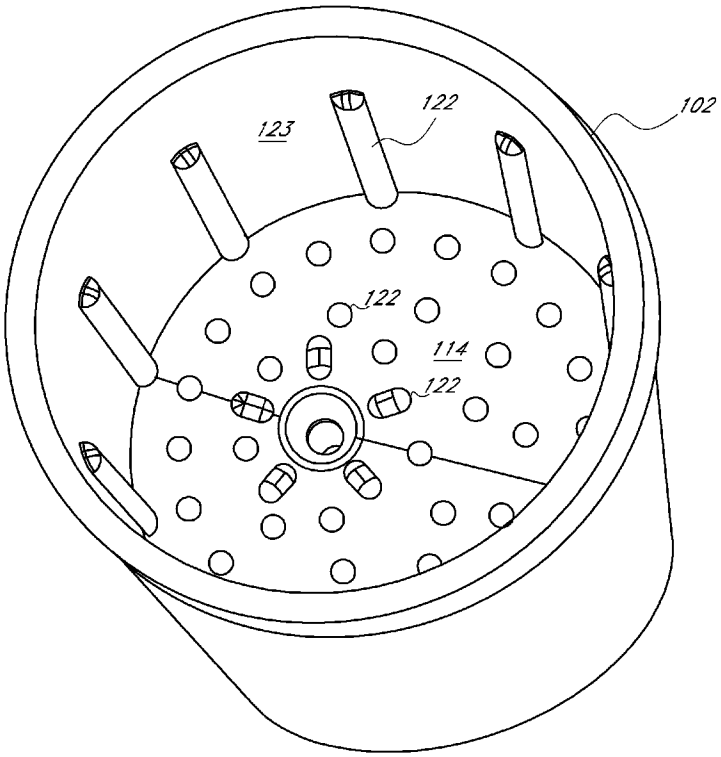
FIG. 1B is a schematic illustration of a receptacle of one embodiment for the pod adaptor assembly of FIG. 1A.
Figure 1A:
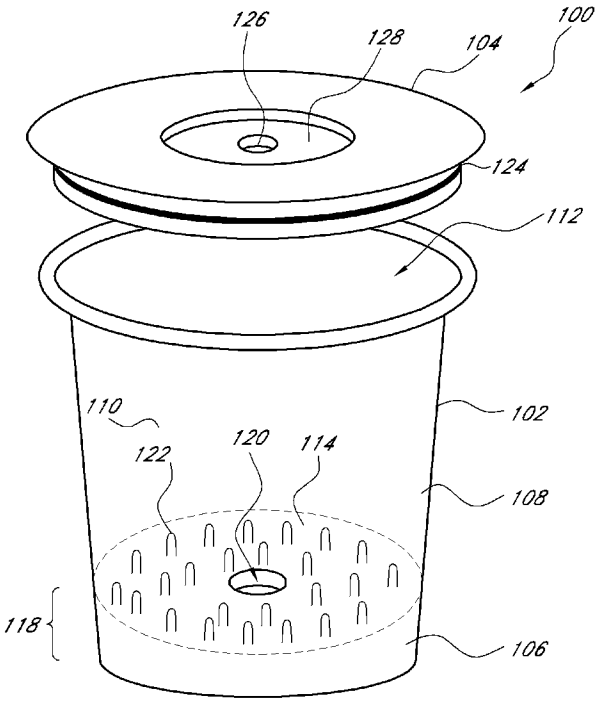
FIG. 1A is a schematic illustration of a pod adaptor assembly of one preferred embodiment of the present invention.

FIG. 1A illustrates a pod adaptor assembly 100 of one embodiment of the present invention. As shown in FIG. 1A, the pod adaptor assembly 100 generally comprises a cup-shaped receptacle 102 and a cover 104 adapted to sealingly engage with the receptacle 102. The receptacle 102 has a substantially circular base 106 and sidewalls 108 extending upwardly from the base 106 to define a housing 110 having an upper opening 112. The base 106 has an interior surface 114 and an exterior surface 116, which are separated by a distance 118 so that the interior surface 114 is elevated above the exterior surface by the distance. In one embodiment, the distance 118 is between 1 and 20 mm. In another embodiment, the distance is about 10 mm. While the preferred embodiments of the pod assembly utilize a cup-shaped receptacle, the receptacle can assume other shapes and configurations such as square or cylindrical without departing from the spirit of the present invention.

As also shown in FIG. 1A, a passageway 120 is formed in the base 106 of the receptacle 102, extending between the interior and exterior surfaces 114, 116 of the base 106. The passageway 120 is configured to receive a needle-like structure that is typically mounted in the single serve beverage brewer to puncture the bottom of a disposable cup-shaped filter. The location of the passageway 120 relative to the base 106 is preferably selected to match the relative location of the needle-like structure in the brewer. In a preferred embodiment, the passageway 120 is slightly off-center from the base to correspond to the location of the needle. In operation, the needle-like structure is designed to move upwardly toward the bottom of the base 104 of the receptacle a first distance so as to puncture the bottom of the cup-shaped filter. To prevent the needle-like structure from hitting against the base of the receptacle or piercing the beverage pod inside the receptacle, the passageway 120 allows the needle-like structure to move freely without jamming against the receptacle or the pod. The passageway 120 also serves the purpose of providing an outlet for brewed beverage to flow out of the receptacle into a drinking vessel. In one embodiment, the passageway 120 is substantially circular and has a diameter of the about 5 mm and a length of about 10 mm.

As FIG. 1A further shows, a plurality of spaced apart protrusions 122 are formed across the interior surface 114 of the base. The protrusions 122 collectively provide a plurality of spaced apart raised surfaces for the pod to rest against. When the pod is placed inside the receptacle and resting against the protrusions, the gaps between the pod the interior surface 114 of the base allow brewed beverage to flow unobstructed from the pod down through the passageway 120. In one implementation, the protrusions can be configured in the manner shown in FIG. 1B. As shown in FIG. 1B, the protrusions 122 comprise a plurality of circular and oval shaped protrusions extending upwardly from the lower surface 114 of the receptacle 102. In some implementations, a plurality of ribs 122 are also arranged to extend outwardly from an interior side surface 123 of the receptacle 102.

As also shown in FIG. 1A, the cover 104 of the assembly 100 has a circular configuration and a seal 124 sized to sealingly engage the cover 104 to the receptacle opening 112 in a manner known in the art. The cover 104 has an opening 126 configured to accommodate a liquid inlet probe from the brewer. The liquid inlet probe is typically used to pierce the cup-shaped filter cartridge and introduce pressurized hot water into the cartridge. In certain embodiments, the cover 104 also has a circular recessed section 128 disposed concentrically around the opening 124. The circular recessed section 128 is adapted to mate with a correspondingly shaped circular protrusion formed on the single serve brewer.

Figure 1C:
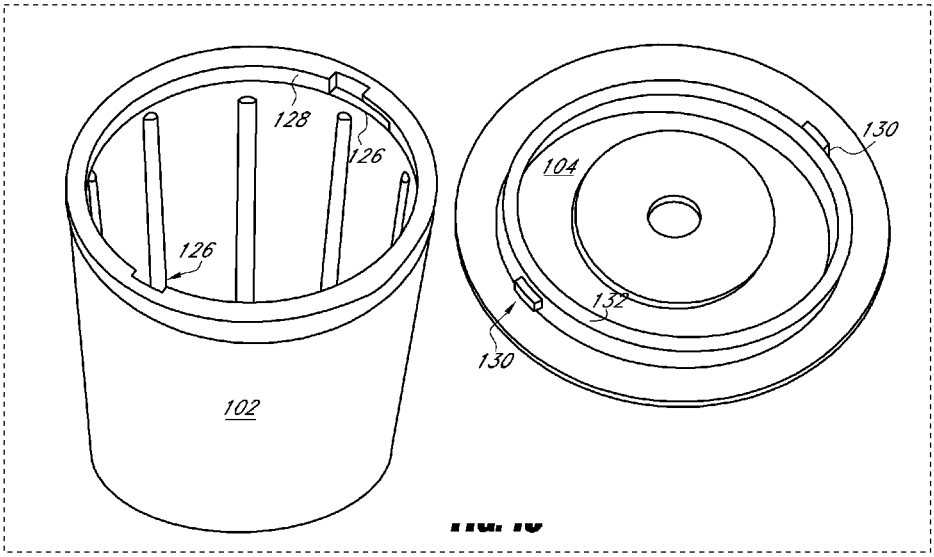
FIG. 1C is a schematic illustration of a receptacle of yet another embodiment of the pod adaptor assembly of FIG. 1A, illustrating a locking mechanism for securing the cover over the receptacle.

In certain embodiments, the assembly 100 further includes a locking mechanism adapted to lock the cover in place relative to the receptacle. FIG. 1C illustrates one example of such locking mechanism. As shown in FIG. 1C, a plurality of notches 126 are formed in the interior rim of the receptacle. The notches 126 are configured to engage with mating protrusions 130 formed on an interior rim 132 of the cover 104. When the cover 104 is positioned over the opening of the receptacle 102, the protrusions 130 on the interior rim 132 of the cover preferably slidably engage with the notch so as to lock the cover in place. It will be appreciated that other locking mechanisms known in the art can also be used to lock the cover in place.

Figure 1D:
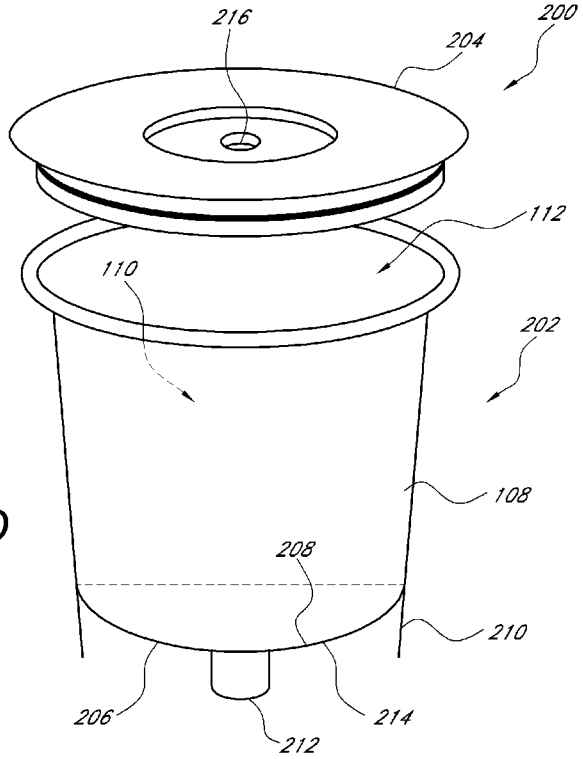
FIG. 1D is a schematic illustration of a pod adaptor assembly of another preferred embodiment of the present invention.

FIG. 1D illustrates a pod adaptor assembly 200 of another embodiment of the present invention. The pod adaptor assembly 200 generally comprises a cup-shaped receptacle 202 adapted to receive a pod and a cover 204 adapted to sealingly engage with the receptacle 202. The receptacle 202 has a base 206 having a downwardly sloping interior surface 208 supported by a plurality of legs 210. A passageway 212 extends downwardly from the exterior surface 214 of the base. The passageway 212 is adapted to guide and allow the needle-like structure from the brewer to extend upwardly without hitting against the receptacle or piercing the pod inside the receptacle. The passageway 212 also permits outflow of the brewed beverage from the receptacle. In one embodiment, the passageway 212 has a diameter of about 5 mm and a length of about 1 mm to 20 mm. The location of the passageway 212 relative to the base 206 is preferably selected to correspond to the location of the upwardly moving needle in the brewer. In one embodiment, the passageway 212 is offset by about 1-5 mm from the center of the base. As also shown in FIG. 1D, the cover 204 of the assembly 200 has an opening 216 formed therethrough, which is adapted to allow insertion of a liquid inlet probe from the brewer.

Figure 1F:
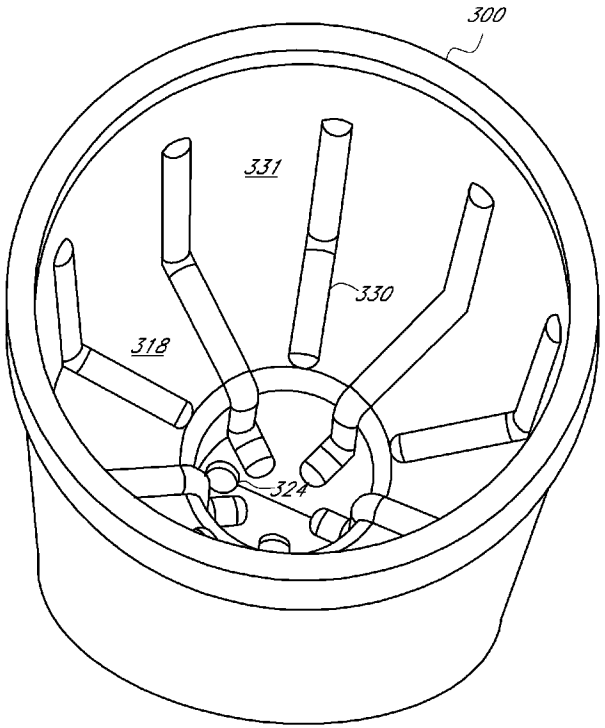
FIG. 1F is a schematic illustration of a receptacle of one embodiment for the pod adaptor assembly of FIG. 1E.
Figure 1E:
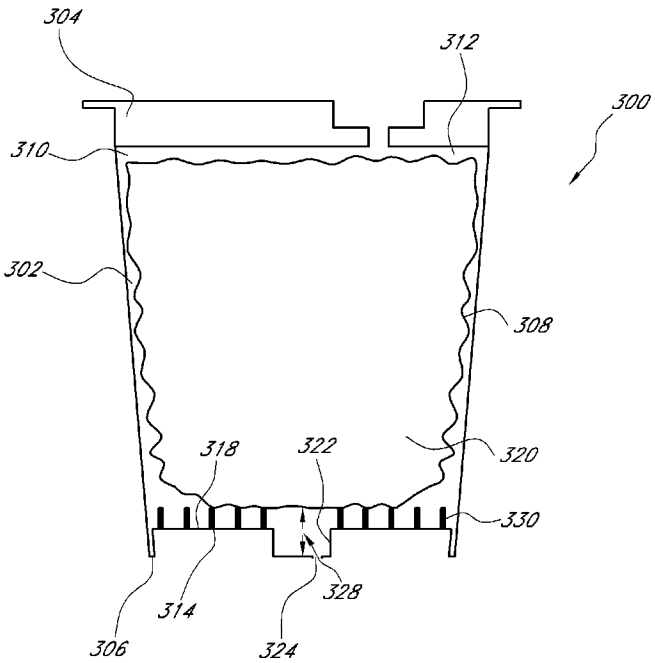
FIG. 1E is a schematic illustration of a pod adaptor assembly of yet another preferred embodiment of the present invention.

FIG. 1E is a schematic illustration of a pod adaptor assembly 300 of another preferred embodiment of the present invention. The pod adaptor assembly 300 generally comprises a receptacle 302 and a cover 304 adapted to sealingly engage with the receptacle 302. The receptacle 302 has a substantially circular base 306 and sidewalls 308 extending upwardly from the base 306 defining a housing 310 having an upper opening 312. The base 306 has an annular raised portion 314 extending upwardly from a lower surface 316 of the base and an opening 324 formed in a portion of the base that is not raised. The raised portion 314 provides a raised support surface 318 for a pod 320 so that the pod 320 does not contact and possibly block the opening 324 for brewed coffee to flow through. Preferably, the lower surface of the pod 320 is also elevated from the opening 324 by a distance 328 which is calculated to accommodate the upward extension of the puncture needle in the brewer during operation. In one embodiment, the distance 328 is between about 5 to 20 mm. In certain preferred embodiments, a plurality of spaced apart protrusions 330 are formed on the raised support surface 318. The gaps between the protrusions facilitate flow of brewed beverage from the pod toward the opening 324.

FIG. 1F illustrates protrusions 330 of one implementation for the receptacle 300 of FIG. 1E. As shown in FIG. 1F, the protrusions 330 comprise a plurality of spaced apart ribs disposed on an interior side wall 331 and both the raised and non-raised interior surface portions 318. As also shown in FIG. 1F, the opening 324 is located at an offset from the center of the base of the receptacle. The location is configured to correspond to the location of the puncture needle when the assembly is placed in the brewing chamber of the brewer.

Figure 1H:
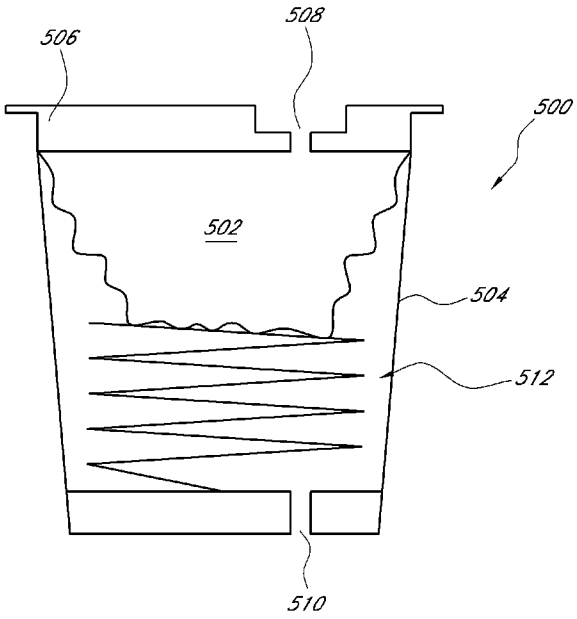
FIG. 1H is a schematic illustration of a pod adaptor assembly of yet another preferred embodiment of the present invention.
Figure 1G:
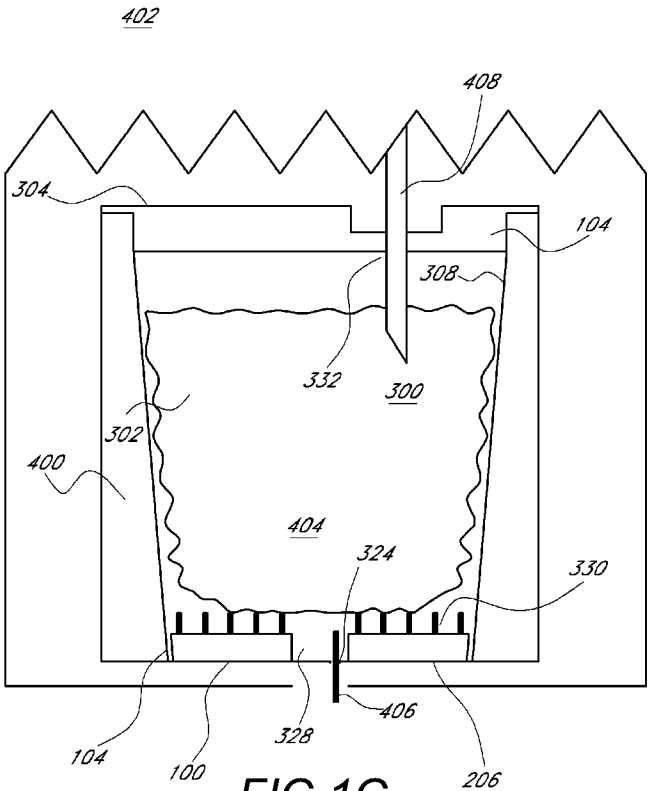
FIG. 1G is a schematic illustration of the pod adaptor assembly of FIG. 3 used in combination with a single serve beverage brewer having upper and lower puncturing devices.

FIG. 1G is a schematic illustration of the pod adaptor assembly of FIG. 1E used in conjunction with a single serve beverage brewer in brewing a beverage pod. As shown in FIG. 1G, the pod adaptor assembly 300 is placed in a brewing chamber 400 of a single serve brewer 402 known in the art and configured for brewing cup-shaped filter cartridges. In one embodiment, the single serve brewer 402 is sold under the trademark KEURIG. As also shown in FIG. 1G, a beverage pod 404, preferably containing ground coffee, is positioned inside the receptacle 302 of the assembly 100. The pod 402 preferably fits snugly inside the receptacle 302 and rests against the protrusion 330. In operation, a lower puncture needle 406 of the brewer extends upwardly through the passageway 116 of the receptacle 102. As described above, the lower puncture needle 406 is designed to extend upwardly and puncture the bottom of a cup-shaped cartridge that is normally inside the brewing chamber. To adapt the brewer 402 for use in brewing beverage pods which do not need to be punctured, the opening 324 in the base of the receptacle allows the puncture needle 406 to extend into the receptacle and the distance 328 between the opening 324 and the pod 404 is dimensioned such that the puncture needle 406 does not contact and pierce the pod 404. The distance advantageously provides an offset that accommodates the upward movement of lower puncture needle 406 without piercing the pod or damaging the needle. As also shown in FIG. 1G, a liquid inlet probe 408 is extended downwardly through an opening 332 formed in the cover 304 of the assembly 300. In some embodiments, the pod 404 is positioned such that the liquid inlet probe 408 punctures the pod 404. In other embodiments, the pod 404 is positioned such that the liquid inlet probe 408 does not puncture the pod.

FIG. 1H is a schematic illustration of yet another embodiment of the pod adaptor assembly 500 of the present invention showing a cross-section of the assembly when used with a beverage pod 502. The pod adaptor assembly 500 comprises a receptacle 504 and a cover 506 adapted to sealingly engage with the receptacle 504. The assembly 500 further includes a biasing mechanism 512 adapted to elevate and press the pod 502 against the cover 506 when the cover is sealingly engaged with the receptacle 504. In one implementation, the pressure applied against the pod advantageously compacts the ground coffee in the pod which has a similar effect as tamping the coffee. In certain preferred embodiments, the assembly has an inlet 508 for introducing pressurized hot water into the receptacle and an outlet 510 for allowing outflow of brewed beverage. In one implementation as shown in FIG. 1H, the inlet 508 is an opening formed in the cover 506 that is also adapted to receive a liquid inlet probe, which is part of a single serve beverage brewers designed for cup-shaped cartridges. Also in the implementation shown in FIG. 1H, the outlet 510 comprises an opening formed in the base of the receptacle to allow for outflow of brewed beverage from the receptacle as well as unobstructed upward extension of a puncture needle that is part of certain single serve beverage brewers designed for cup-shaped cartridges. By pressing the pod up against the cover, the pod is also pressed up against the inlet 508 through which hot water flows into the chamber. This advantageously "traps" the hot water in the pod for a longer period of time and produces a stronger and more consistent brewed beverage. In addition to being an adaptor assembly for cup-shaped brewers, the receptacle having a biasing device as shown in FIG. 1H can also serve as a brewing chamber for pod brewers.

In one embodiment, the biasing mechanism 512 is a spring positioned inside the receptacle and extending upwardly from the base. The flexibility of spring is advantageous because it provides an adjustable support surface that can accommodate and apply pressure against pods of a variety of different sizes. In cases of thicker or larger pods, the spring can be simply compressed more to accommodate the pods. The spring can push the pods of different thicknesses and sizes up against the hot water being introduced into the receptacle. It will also be appreciated that a variety of different biasing mechanisms can also be used to press the pod against the inlet hot water. For example, the biasing mechanism can be a spring attached to the interior of the cover. As described above, pushing the pod against the hot water inlet compacts the ground coffee and also causes much less water to escape from the pod during the brewing pod. As a result, a much stronger and consistent cup of coffee is produced.

Figure 1I:
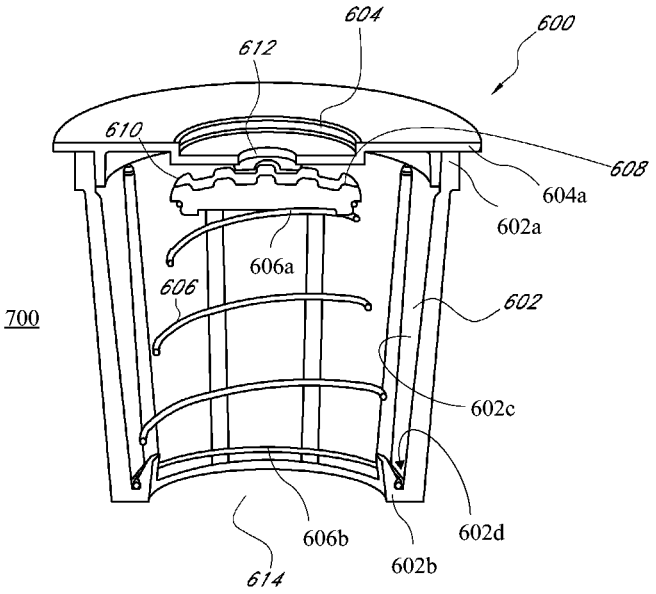
FIG. 1I is a schematic illustration of a cross-sectional view of a pod brewing chamber of one preferred embodiment of the present invention.
Figure 6:
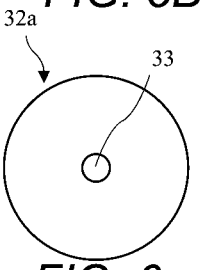
FIG. 6 is a top view of the first holder lid.

FIG. 1I is a cross-sectional view of a pod brewing chamber 600 of one preferred embodiment of the present invention incorporating the novel biasing mechanism. The pod brewing chamber 600 comprises a cup-shaped housing 602 and a cover 604. Preferably, the housing 602 has a frustoconical shaped interior surface 602*c* and is sized to receive a circular beverage pod. In a preferred embodiment, the housing 602 has a height of about 44.5 mm, a lower diameter of about 35 mm and an upper diameter of about 45.5 mm. As also shown in FIG. 6, the brewing chamber 600 further includes a spring 606 extending upwardly from the base 602*b* of the housing and having an upper end 606*a* and base 606*b*, the base 606*b* residing in a notch 602*d* in the base of the housing 602 and a platform 608 attached to the upper end 606*a* of the spring 606. In one implementation, the platform 608 comprises a circular support having ribs arranged in a spaced part configuration across the upper surface of the platform 608. In operation, a coffee pod is inserted into the housing by being placed on the platform 608 and pressed downwardly until the pod is inside the housing and the cover 604 can be placed over the opening of the housing. As also shown in FIG. 6, the cover 604 has an opening 612 through which hot water can be injected into the housing, and a rim 604*a* radially overlapping a top edge 602*a* of the housing 602. The rim 604*a* provides a graspable portion residing outside the interior of the housing 602 for removal of the cover 604. The brewing chamber further includes a lower opening 614 in the base 602*b* of the housing 602 for brewed coffee to flow out of the chamber, and a chamber exterior region 700 outside the brewing chamber.

In addition to the KEURIG coffee makers, the adapters described in FIGS. 1A-1I may be used in conjunction with a variety of different conventional pod brewers, such as those described in U.S. Pat. Nos. 6,904,840, 7,047,870 and 7,131, 369, which are hereby incorporated by reference.

Figures 2A, 2B, 2C:
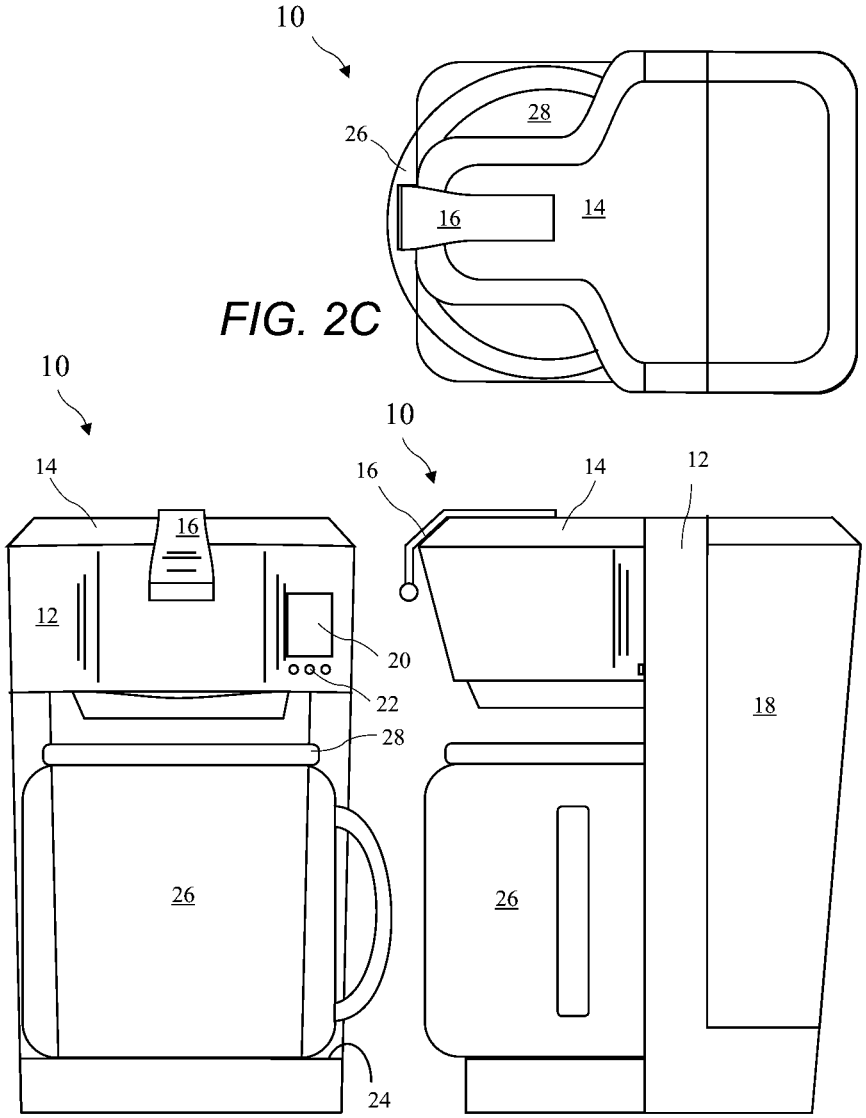
FIG. 2A is a front view of a coffee maker according to the present invention.
FIG. 2B is a side view of the coffee maker according to the present invention.
FIG. 2C is a top view of the coffee maker according to the present invention.

A front view of a coffee 10 maker according to the present invention is shown in FIG. 2A a side view of the coffee maker 10 is shown in FIG. 2B, and a top view of the coffee maker 10 is shown in FIG. 2C. The coffee maker 10 includes a body 12, an opening lid 14, a lid handle 16, a water container 18, a display 20, controls 22, and platform 24. A coffee pitcher 26 rests on the platform 24 and has a pitcher lid 28. The coffee maker 10 provides a flow of hot water through coffee grounds to produce a coffee drink. The flow of water may be heated by one of any known means, for example, an electrical heating coil or a conductive coating on tubing carrying the water.

Figure 2E:
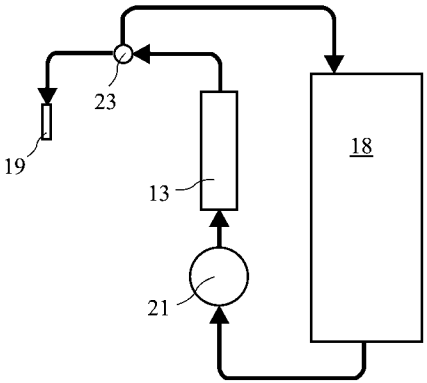
FIG. 2E is a functional diagram of the coffee maker.
Figure 2D:
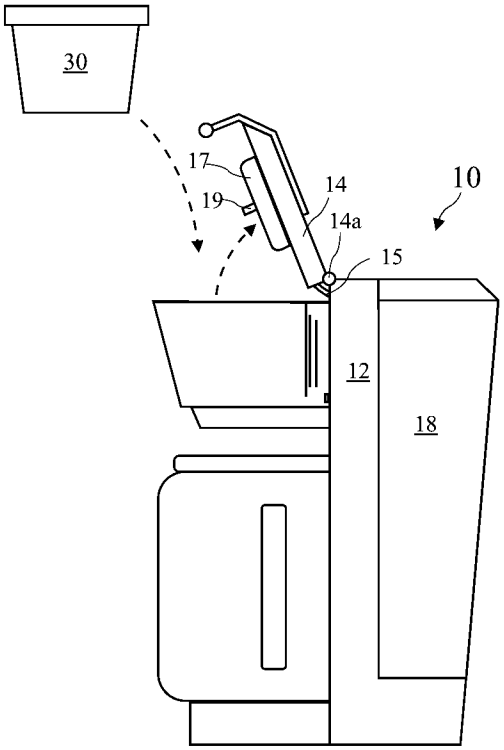
FIG. 2D is a side view of the coffee maker with an open lid allowing placement of a coffee holder according to the present invention inside the coffee maker.

A side view of the coffee maker 10 with an open lid 14 allowing placement of a coffee holder 30 according to the present invention inside the coffee maker 10 is shown in FIG. 2D. The lid 14 includes a lid hinge 14*a* and a water tube 15 carries heated water into the lid 14. A pad 17 resides on a bottom surface of the lid 14 and presses against the coffee holder 30 when the lid 14 is closed, and in cooperation with other means discloses hereafter, tamps coffee contained in the coffee holder 30. A nozzle 19 extending down from the closed lid 14 directs the flow of hot water into the coffee holder 30.

A functional diagram of the coffee maker 10 is shown in FIG. 2E. The preferred coffee maker 10 includes the water tank 18, water pump 21, a heater 13, check valve 23 and the nozzle 18. The pump 21 preferably provides at least one PSI water pressure. The water heater 13 may include a heating coil or a resistive coating or any other means for heating water. The check valve 23 limits the water pressure at the nozzle 19 by returning some of the water flow to the water tank 18. While the water pump 21 is a preferred method for providing a flow of water to the nozzle 19, other methods include pressuring the water in the water tank 18, and a coffee maker using any means to provide a forced flow of water is intending to within the scope of the present invention.

Figure 3:
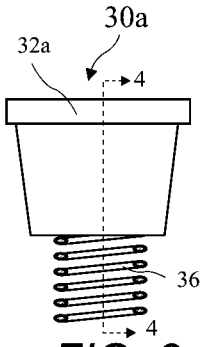
FIG. 3 is a side view of a first coffee holder according to the present invention.
Figure 4:
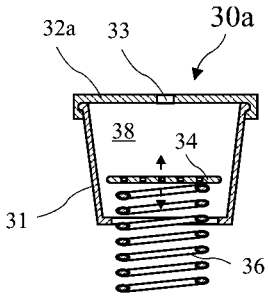
FIG. 4 is a cross-sectional side view of the first coffee holder according to the present invention taken along line 4-4 of FIG. 3.

A side view of a first coffee holder 30*a* according to the present invention is shown in FIG. 3 and a cross-sectional side view of the first coffee holder 30*a* including a holder body 31, a first holder lid 32*a*, a bottom tamper 34, and a tamping spring 35 according to the present invention taken along line 4-4 of FIG. 3 is shown in FIG. 4. A volume (or coffee holder interior) 38 is provided inside the coffee holder 30*a* to receive loose coffee 41. A passage 33 in the lid 32*a* is provided for the nozzle 19 (see FIG, 2).

Figure 5A:
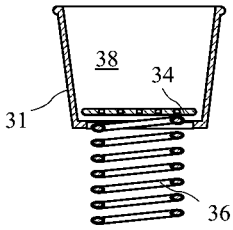
FIG. 5A is a cross-sectional side view of the first coffee holder according to the present invention taken along line 4-4 of FIG. 3 showing an empty coffee holder with the tamping spring and the bottom tamper according to the present invention.
Figure 5B:
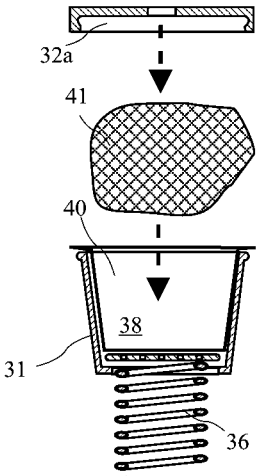
FIG. 5B is a cross-sectional side view of the first coffee holder according to the present invention taken along line 4-4 of FIG. 3 showing the coffee holder with the tamping spring and bottom tamper, a portion of coffee, and the holder lid ready to attach to a holder body according to the present invention.
Figure 5C:
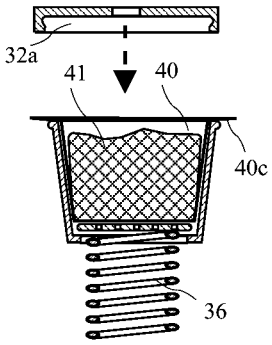
FIG. 5C is a cross-sectional side view of the first coffee holder according to the present invention taken along line 4-4 of FIG. 3 showing the coffee holder with the tamping spring and bottom tamper, the portion of coffee in the coffee holder, and the holder lid ready to attach to the holder body according to the present invention.
Figure 5D:
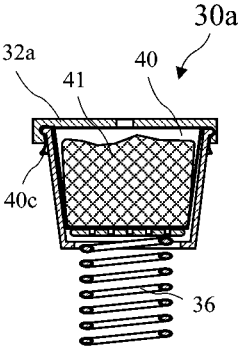
FIG. 5D is a cross-sectional side view of the first coffee holder according to the present invention taken along line 4-4 of FIG. 3 showing the coffee holder with the tamping spring and bottom tamper, the portion of coffee in the coffee holder, and the holder lid attached to the coffee holder body, according to the present invention.

A cross-sectional side view of the first coffee holder 30*a* taken along line 4-4 of FIG. 3 showing an empty coffee holder 30*a* with the tamping spring 36 and the bottom tamper 34 ready for filling are shown in FIG. 5A. A cross-sectional side view of the first coffee holder 30*a* taken along line 4-4 of FIG. 3 showing the coffee holder 30*a* with the tamping spring 36 and bottom tamper 34, a portion of loose coffee 41, and the holder lid 32*a* ready to attach is shown in FIG. 5B. A cross-sectional side view of the first coffee holder 30*a* taken along line 4-4 of FIG. 3 showing the coffee holder 30*a* with the tamping spring 36 and bottom tamper 34, a portion of coffee in the volume 38, and the holder lid 32*a* ready to attach is shown in FIG. 5C. A cross-sectional side view of the first coffee holder 30*a* taken along line 4-4 of FIG. 3 showing the coffee holder 30*a* with the tamping spring 36 and bottom tamper 34, a portion of loose coffee 41 in the volume 38, and the holder lid 32*a* attached to the coffee holder 30*a*, is shown in FIG. 5D.

A top view of the first holder lid 32*a* showing the passage 33 provided for the nozzle 19 (see FIG. 2) is shown in FIG. 6.

Figure 7A:
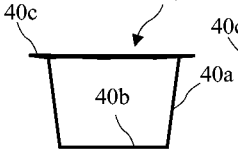
FIG. 7A is a side view of a filter paper cup according to the present invention.
Figure 7B:
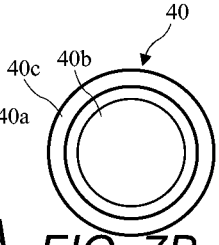
FIG. 7B is a top view of the filter paper cup according to the present invention.

A side view of a filter paper cup 40 according to the present invention is shown in FIG. 7A and a top view of the filter paper cup 40 is shown in FIG. 7B. The filter paper cup 40 includes a bottom 40*b*, sides 40*a*, and a rim 40*c*. The rim 40*c* rests on a top edge of the holder body 31 and is held between the holder cap and body when the cap is placed on the body, thereby preventing or restricting the escape of coffee 41 from the cup 40 when hot water flows into the coffee holder 30*a*.

Figure 7C:
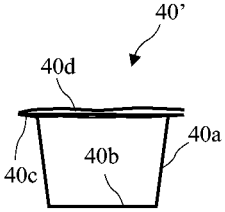
FIG. 7C is a second embodiment of the filter paper cup with a lid.

A second embodiment of the filter paper cup 40' with a lid 40*d* is shown in FIG. 7C. The lid 40*d* of the filter paper cup 40' may be folded over the cup 40' after loose coffee is poured into the cup.

The filter cups may be made from several materials including filter paper, nylon mesh, steel mesh, or any material suitable for filtration.

Figures 8A, 8B, 8C:
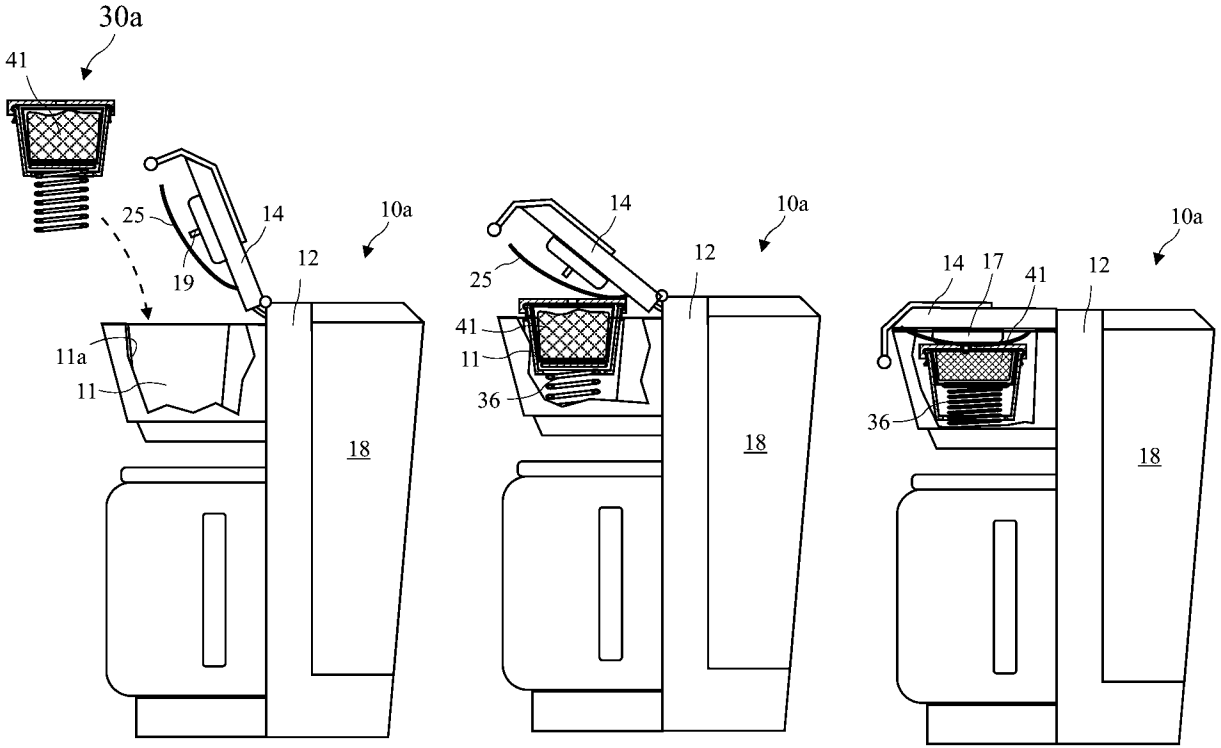
FIG. 8A shows the first coffee holder ready for insertion into the coffee maker.
FIG. 8B shows the first coffee holder inserted into the coffee maker before tamping the coffee.
FIG. 8C shows the first coffee holder inserted into the coffee maker after tamping the coffee.

The first coffee holder 30*a* is shown ready for insertion into a first coffee maker 10*a* in FIG. 8A, the first coffee holder 30*a* is shown inserted into the coffee maker 10 before tamping the coffee 41 in FIG. 8B, and the first coffee holder 30*a* is shown in the coffee maker 10 after tamping the coffee 41 in FIG. 8C. The coffee maker includes a cavity 11 for accepting the coffee holder and has walls 11*a* for aligning the coffee holder in the coffee maker. When the lid 14 is closed, the pad 17 on the bottom of the lid 14 and/or arms 25 attached to the bottom of the lid 25, push the coffee holder 30*a* down over the tamping spring 36 and the coffee 41 is tamped between the lid 32*a* and the bottom tamper 34. The arms 25 push the coffee holder 30*a* down ahead of the nozzle 19 thereby seating the coffee holder 30*a* in the cavity 11 for alignment of the nozzle 10 with the passage 33 in the lid 32*a*.

Figure 9:
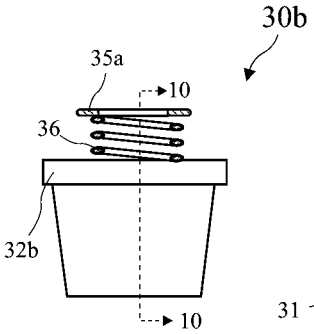
FIG. 9 is a side view of a second coffee holder according to the present invention.
Figure 10:
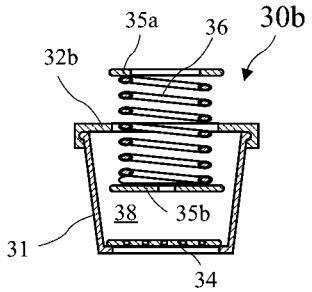
FIG. 10 is a cross-sectional side view of the second coffee holder according to the present invention taken along line 10-10 of FIG. 9.

A side view of a second coffee holder 30*b* according to the present invention is shown in FIG. 9 and a cross-sectional side view of the second coffee holder 30*b* taken along line 10-10 of FIG. 9 is shown in FIG. 10. The coffee holder 30*b* includes the holder body 31, a second holder lid 32*b*, a tamper spring 36, a spring washer 35*a*, and a top tamper 35*b*.

Figure 11A:
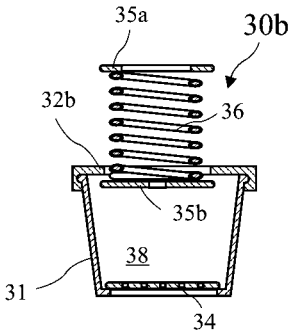
FIG. 11A is a cross-sectional side view of the second coffee holder according to the present invention taken along line 10-10 of FIG. 9 showing an empty coffee holder with the tamping spring and the top tamper according to the present invention.
Figure 11B:
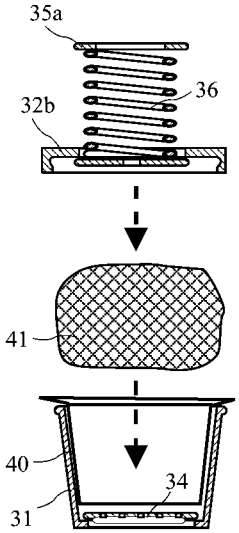
FIG. 11B is a cross-sectional side view of the second coffee holder according to the present invention taken along line 10-10 of FIG. 9 showing the coffee holder with the holder lid, tamping spring and top tamper, and a portion of coffee, ready to attach according to the present invention.
Figure 11C:
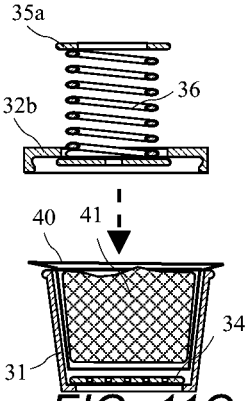
FIG. 11C is a cross-sectional side view of the second coffee holder according to the present invention taken along line 10-10 of FIG. 9 showing the portion of untamped coffee in the coffee holder, and the holder lid, tamping spring and top tamper, ready to attach to the holder base, according to the present invention.
Figure 11D:
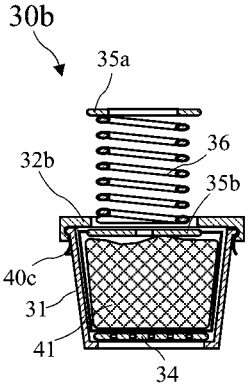
FIG. 11D is a cross-sectional side view of the second coffee holder according to the present invention taken along line 10-10 of FIG. 9 showing the portion of coffee in the coffee holder and the tamping spring, top tamper, and the holder lid attached to the coffee holder, according to the present invention.

A cross-sectional side view of the second coffee holder 30*b* taken along line 10-10 of FIG. 9 showing an empty coffee holder 30*b* is shown in FIG. 11A. A cross-sectional side view of the second coffee holder 30*b* taken along line 10-10 of FIG. 9 showing the holder lid 32*b* and a loose portion of coffee 41 above the empty coffee holder 30*b* is shown in FIG. 11 B. A cross-sectional side view of the second coffee holder 30*b* taken along line 10-10 of FIG. 9 showing the holder lid 32*b* above the coffee holder 30*b* with the portion of loose coffee 41 in the coffee holder 32*b* is shown in FIG. 11C. A cross-sectional side view of the second coffee holder 32*b* taken along line 10-10 of FIG. 9 showing the coffee holder with the holder lid 32*b* attached to the coffee holder 30*b* and a portion of loose coffee 41 in the coffee holder 30*b* is shown in FIG. 11D. The tamping spring 36 extends upward out of the coffee holder 30*b* for tamping the loose coffee as disclosed hereafter.

Figure 12:
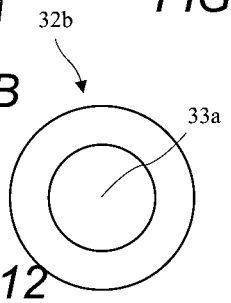
FIG. 12 is a top view of the second holder lid.

A top view of the second holder lid 32*b* is shown in FIG. 12. The holder lid 32*b* includes a larger passage 33*a* allowing passage of the tamping spring 36 through the holder lid 32*b*.

Figure 13:
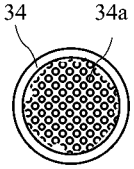
FIG. 13 is a top view of the bottom tamper.

A top view of the bottom tamper 34 is shown in FIG. 13. The bottom tamper 34 includes perforations 34*a* to allow coffee drink to pass through the bottom tamper 34.

Figure 14A:
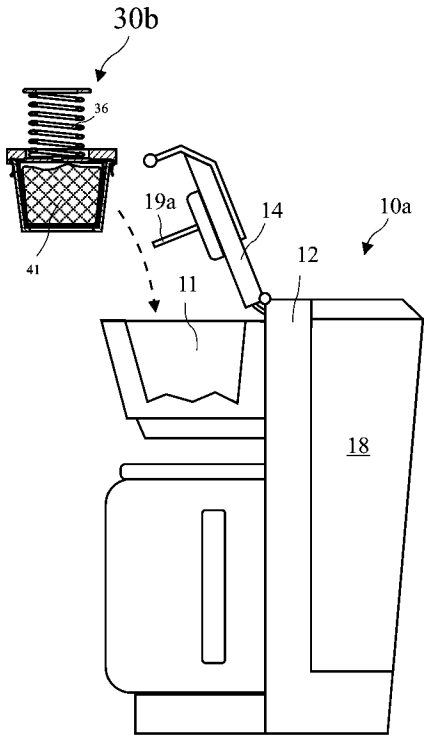
FIG. 14A shows the second coffee holder ready for insertion into the coffee maker.
Figure 14B:
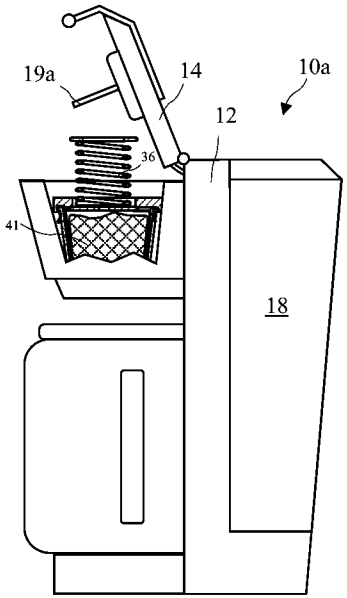
FIG. 14B shows the second coffee holder inserted into the coffee maker before tamping the coffee.
Figure 14C:
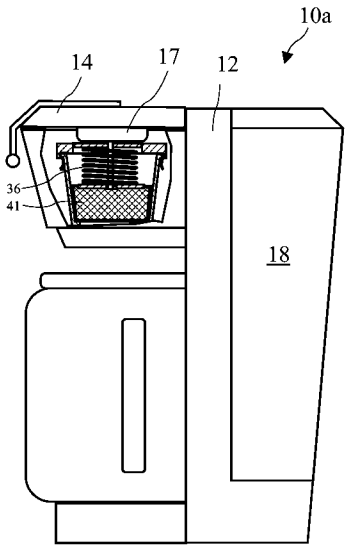
FIG. 14C shows the second coffee holder inserted into the coffee maker after tamping the coffee.

The second coffee holder 30*b* is shown ready for insertion into the coffee maker 10 in FIG. 14A, the second coffee holder 30*b* is shown inserted into the coffee maker 10 before tamping the coffee 41 in FIG. 14B, and the second coffee holder 30*b* is shown in the coffee maker 10 after tamping the coffee 41 in FIG. 14C. The coffee maker 10 may include a long nozzle 19*a* to reach the top tamper 35*b* for "injection" of the heated water into the tamped coffee, but may also include the nozzle 19 and the heated water may pass through the coffee 41 under the pull of gravity.

Figure 15:
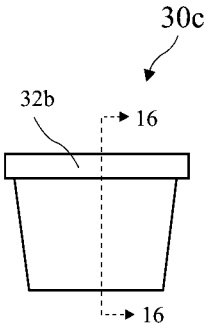
FIG. 15 is a side view of a third coffee holder according to the present invention.
Figure 16:
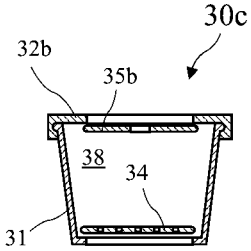
FIG. 16 is a cross-sectional side view of the third coffee holder according to the present invention taken along line 16-16 of FIG. 15.

A side view of a third coffee holder 30*c* according to the present invention is shown in FIG. 16 and a cross-sectional side view of the third coffee holder 30*c* taken along line 16-16 of FIG. 15 is shown in FIG. 16. The coffee holder 30*c* includes the holder body 31, the second holder lid 32*b*, the bottom tamper 34, and the top tamper 35*b*.

Figure 17A:
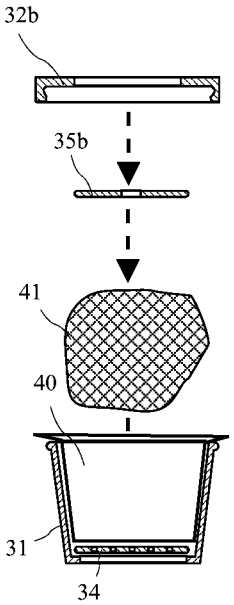
FIG. 17A is a cross-sectional side view of the third coffee holder according to the present invention taken along line 16-16 of FIG. 15 showing the portion of coffee above the coffee holder and the top tamper and the holder lid ready to attach to the coffee holder, according to the present invention.
Figure 17B:
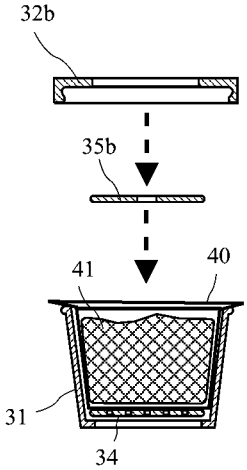
FIG. 17B is a cross-sectional side view of the third coffee holder according to the present invention taken along line 16-16 of FIG. 15 showing the portion of coffee in the coffee holder, and the top tamper and the holder lid ready to attach to the coffee holder, according to the present invention.
Figure 17C:
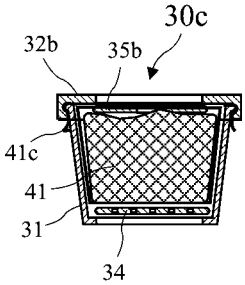
FIG. 17C is a cross-sectional side view of the third coffee holder according to the present invention taken along line 16-16 of FIG. 15 showing the portion of coffee in the coffee holder, and the bottom tamper, the top tamper, and the holder lid attached to the coffee holder, according to the present invention.

A cross-sectional side view of the third coffee holder 30*c* taken along line 16-16 of FIG. 15 showing the coffee holder 30*c* with the holder lid 32*b*, the top tamper 35*b*, and a portion of coffee, ready to attach to the holder 31, is shown in FIG. 17A. A cross-sectional side view of the third coffee holder taken along line 16-16 of FIG. 15 showing the coffee holder 30*c* with the holder lid 32*b* and the top tamper ready to attach, and a portion of coffee 41 in the coffee holder, is shown in FIG. 17B. A cross-sectional side view of the third coffee holder 30*c* taken along line 16-16 of FIG. 15 showing the coffee holder with the holder lid and the top tamper attached and a loose portion of coffee 41 in the coffee holder is shown in FIG. 17C. The coffee holder 30*c* is configured to use with a coffee maker 10*b* (see FIGS. 18A-18C) including apparatus for entering the coffee holder for tamping the loose coffee 41.

Figures 18A, 18B, 18C:
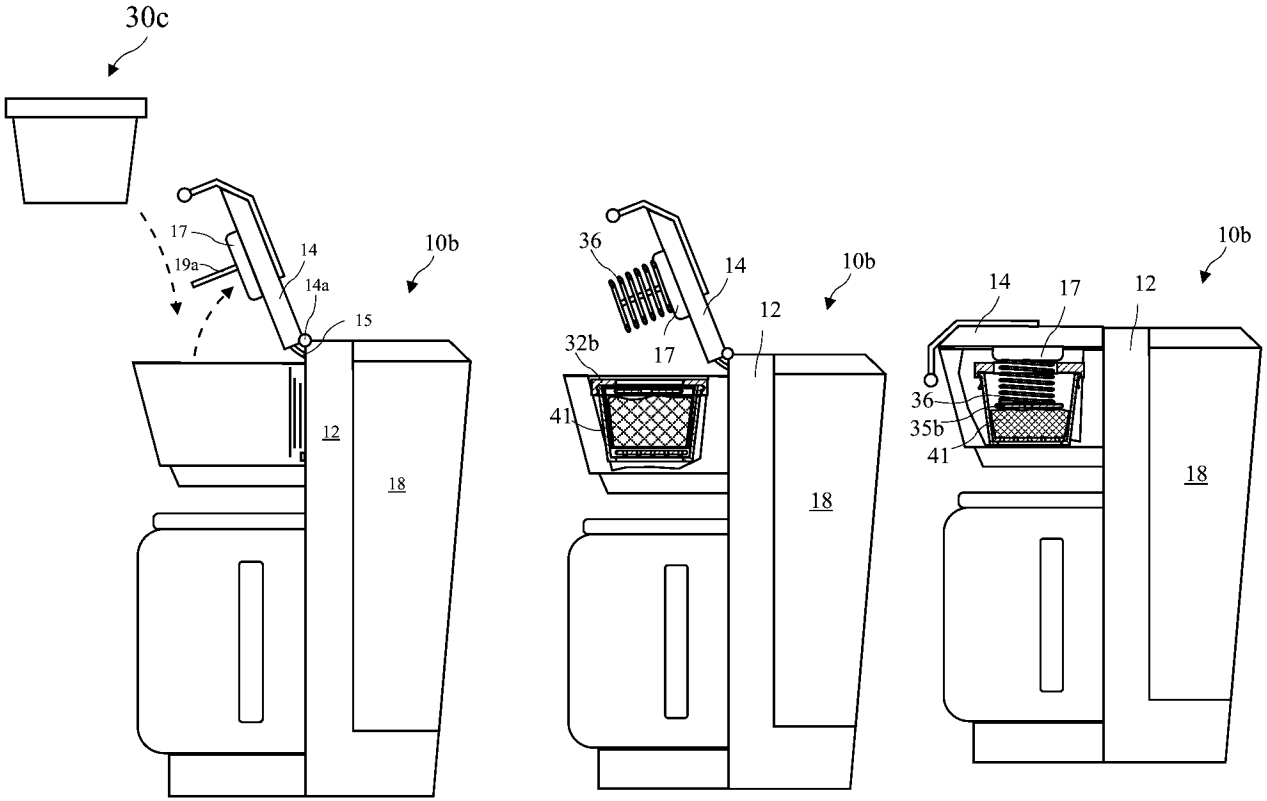
FIG. 18A shows the third coffee holder ready for insertion into a second coffee maker according to the present invention.
FIG. 18B shows the third coffee holder inserted into the coffee maker before tamping the coffee.
FIG. 18C shows the third coffee holder inserted into the coffee maker after tamping the coffee.

The third coffee holder 30*c* ready for insertion into a second coffee maker 10*b* in FIG. 18A, the third coffee holder 30*c* is shown residing in the coffee maker 10*b* before tamping the coffee 41 in FIG. 18B, and the third coffee holder 30*c* is shown residing in the coffee maker 10*b* after tamping the coffee 41 in FIG. 18C. The coffee maker 10*b* includes the tamping spring 36 attached to the pad 17 on the bottom of the lid 14. When the lid 14 is closed the tamping spring 36 enters the coffee holder 30*c* through the lid passage 33*a* (see FIG. 12) and pushes the top tamper 35*b* against the coffee 41 to tamp the coffee 41.

Figure 19:
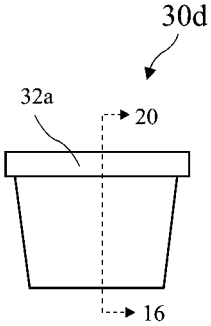
FIG. 19 is a side view of a fourth coffee holder according to the present invention.
Figure 20:
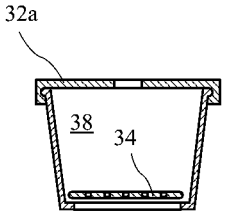
FIG. 20 is a cross-sectional side view of the fourth coffee holder according to the present invention taken along line 20-20 of FIG. 19.

A side view of a fourth coffee holder 30*d* according to the present invention is shown in FIG. 19 and a cross-sectional side view of the fourth coffee holder 30*d* taken along line 20-20 of FIG. 19 is shown in FIG. 20. The coffee holder 30*d* includes the holder body 31, the first holder lid 32*a*, and the bottom tamper 34.

Figure 21A:
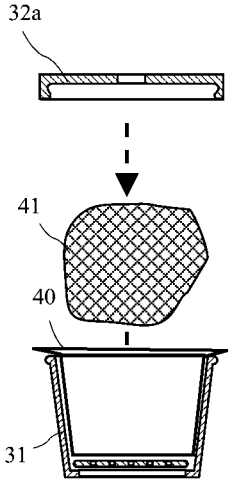
FIG. 21A is a cross-sectional side view of the fourth coffee holder according to the present invention taken along line 20-20 of FIG. 19 showing the coffee holder with the bottom tamper, a portion of coffee, and the holder lid ready to attach, according to the present invention.
Figure 21B:
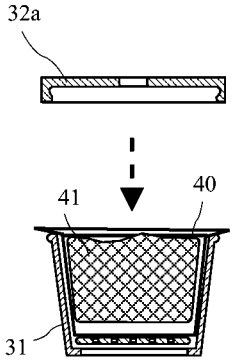
FIG. 21B is a cross-sectional side view of the fourth coffee holder according to the present invention taken along line 20-20 of FIG. 19 showing the coffee holder with the bottom tamper, a portion of coffee in the coffee holder, and the holder lid ready to attach, according to the present invention.
Figure 21C:
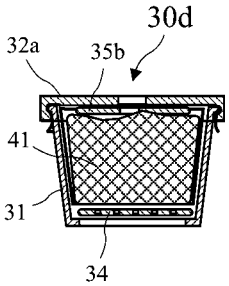
FIG. 21C is a cross-sectional side view of the fourth coffee holder according to the present invention taken along line 20-20 of FIG. 19 showing the coffee holder with the bottom tamper, a portion of coffee in the coffee holder, and the holder lid attached, according to the present invention.

A cross-sectional side view of the fourth coffee holder 30*d* taken along line 20-20 of FIG. 19 showing the coffee holder with the bottom tamper 34, and a portion of coffee 41 and the holder lid ready to attach is shown in FIG. 21A. A cross-sectional side view of the fourth coffee holder 30*d* taken along line 20-20 of FIG. 19 showing the coffee holder 30*d* with the bottom tamper 34, the portion of coffee 41 in the coffee holder 30*d*, and the holder lid 32*a* ready to attach is shown in FIG. 21B. A cross-sectional side view of the fourth coffee holder 30*d* taken along line 20-20 of FIG. 19 showing the coffee holder 30*d* with the bottom tamper 34, a portion of coffee in the coffee holder 41, and the holder lid 32*a* is shown in FIG. 21C.

Figure 22A:
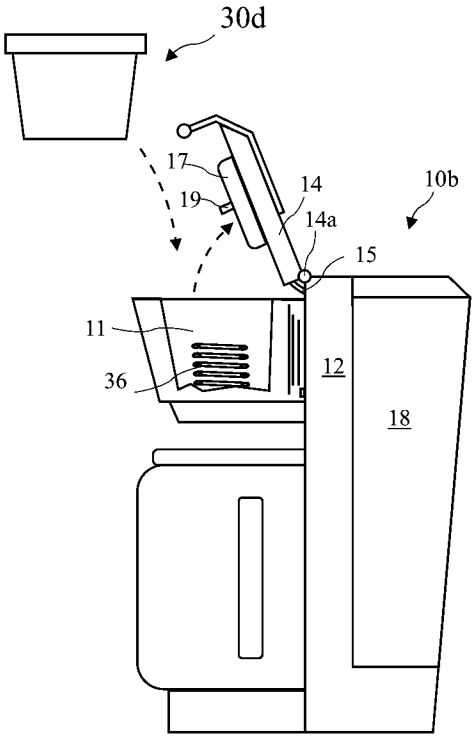
FIG. 22A shows the fourth coffee holder ready for insertion into the coffee maker.
Figure 22B:
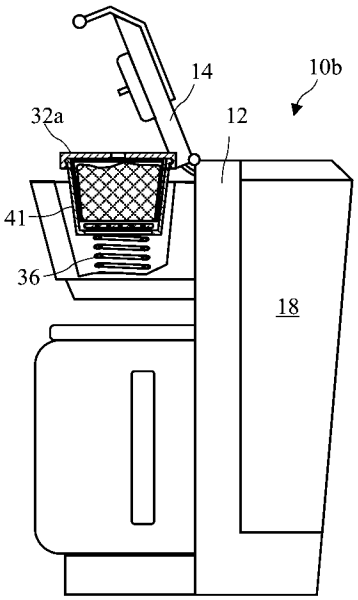
FIG. 22B shows the fourth coffee holder inserted into the coffee maker before tamping the coffee.
Figure 22C:
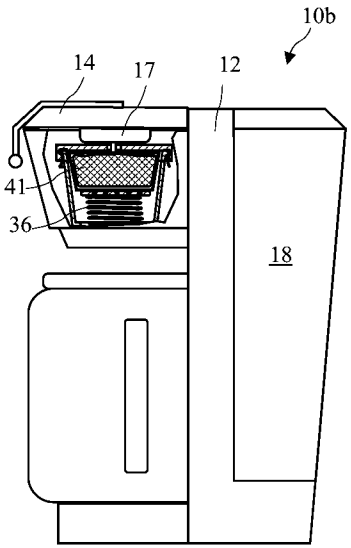
FIG. 22C shows the fourth coffee holder inserted into the coffee maker after tamping the coffee.

The fourth coffee holder 30*d* ready for insertion into another embodiment of the second coffee maker 10*b* in FIG. 22A, the fourth coffee holder 30*d* is shown residing in the coffee maker 10*b* before tamping the coffee 41 in FIG. 22B, and the fourth coffee holder 30*d* is shown residing in the coffee maker 10*b* after tamping the coffee 41 in FIG. 22C. The coffee maker 10*b* may include the tamping spring 36 residing in the bottom of the coffee holder cavity 11. When the lid 14 is closed, the pad 17 pushed the coffee holder 30*d* down over the tamping spring 36 and the tamping spring 36 enters the coffee holder 30*c* through the bottom of the holder body 31 and pushes the bottom tamper 34 against the coffee 41 to tamp the coffee 41.

Figure 23C:
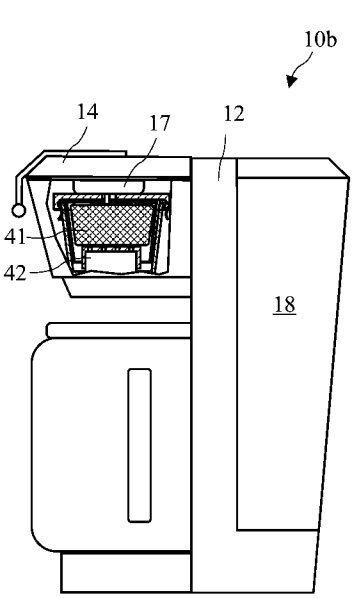
FIG. 23C shows the fourth coffee holder inserted into the coffee maker having the tamping block after tamping the coffee.
Figure 23B:
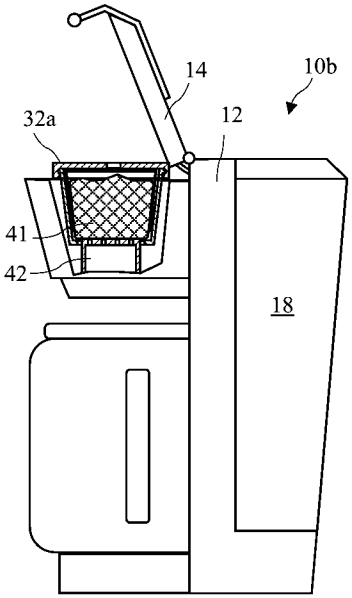
FIG. 23B shows the fourth coffee holder inserted into the coffee maker having the tamping block before tamping the coffee.
Figure 23A:
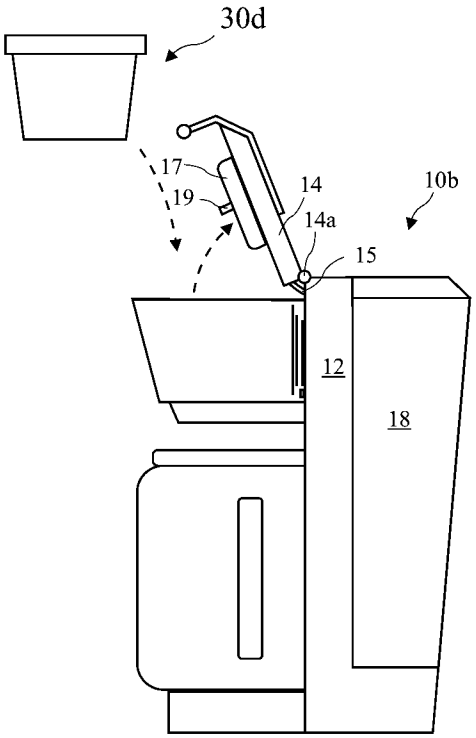
FIG. 23A shows the fourth coffee holder ready for insertion into the coffee maker having a tamping block according to the present invention.

The fourth coffee holder 30*d* ready for insertion into another embodiment of the second coffee maker 10*b* in FIG. 23A, the fourth coffee holder 30*d* is shown residing in the coffee maker 10*b* before tamping the coffee 41 in FIG. 23B, and the fourth coffee holder 30*d* is shown residing in the coffee maker 10*b* after tamping the coffee 41 in FIG. 23C. The coffee maker 10*b* may include a resilient solid block 42 residing in the bottom of the coffee holder cavity 11. When the lid 14 is closed, the pad 17 pushed the coffee holder 30*d* down over the resilient solid block 42 and the resilient solid block 42 enters the coffee holder 30*c* through the bottom of the holder body 31 and pushes the bottom tamper 34 against the coffee 41 to tamp the coffee 41.

Figure 24:
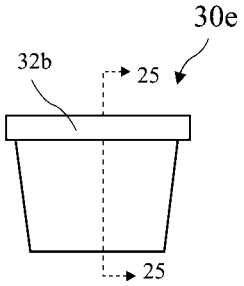
FIG. 24 is a side view of a fifth coffee holder according to the present invention.
Figure 25:
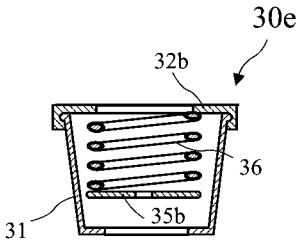
FIG. 25 is a cross-sectional side view of the fifth coffee holder according to the present invention taken along line 25-25 of FIG. 24.

A side view of a fifth coffee holder 30*e* according to the present invention is shown in FIG. 24 and a cross-sectional side view of the fifth coffee holder 30*e* taken along line 25-25 of FIG. 24 is shown in FIG. 25. The fifth coffee holder 30*e* includes the holder body 31, the holder lid 32*b*, the tamping spring 36 and the top tamper 35*b* attached to the holder lid 32*a*.

Figure 26A:
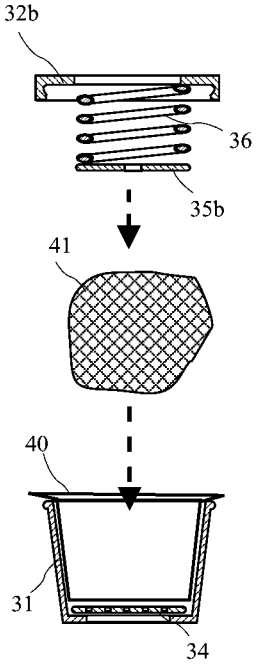
FIG. 26A is a cross-sectional side view of the fifth coffee holder according to the present invention taken along line 25-25 of FIG. 24 showing the portion of coffee above the coffee holder body, and the holder lid with the top tamper and tamping spring, ready to attach to the coffee holder body, according to the present invention.
Figure 26B:
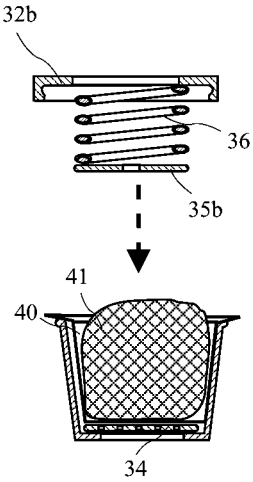
FIG. 26B is a cross-sectional side view of the fifth coffee holder according to the present invention taken along line 25-25 of FIG. 24 showing the coffee holder with the portion of coffee in the coffee holder, and the holder lid with the top tamper and tamping spring ready to attach to the coffee holder body, according to the present invention.
Figure 26C:
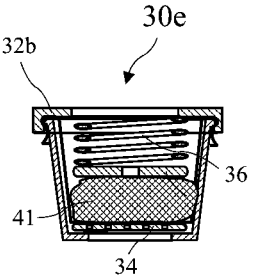
FIG. 26C is a cross-sectional side view of the fifth coffee holder according to the present invention taken along line 25-25 of FIG. 24 showing the portion of coffee in the coffee holder, and the holder lid with the top tamper and tamping spring attached to the holder body, according to the present invention.

A cross-sectional side view of the fifth coffee holder 30*e* taken along line 25-25 of FIG. 24 showing the coffee holder 30*e* with a portion of coffee 41, and the holder lid 32*b* with the top tamper 35*b* and tamping spring 36 attached, above the holder body 31, is shown in FIG. 26A. A cross-sectional side view of the fifth coffee holder 30*e* taken along line 25-25 of FIG. 24 showing the coffee holder with the portion of coffee 41 in the coffee holder, and the holder lid 32*b* with the top tamper 35*b* and tamping spring 36 attached, above the holder body 31, is shown in FIG. 26B. A cross-sectional side view of the fifth coffee holder 30*e* taken along line 25-25 of FIG. 24 showing the coffee holder 30*e* with the portion of coffee 41 in the coffee holder 30*e*, and the holder lid 32*b* with the top tamper 35*b* and tamping spring 36 attached to the holder base 31 is shown in FIG. 26D. The tamper spring 36 and top tamper 35*b* tamp the coffee 41 to provide a tamped coffee when the holder lid 32*b* is attached to the holder base 31.

Figure 27:
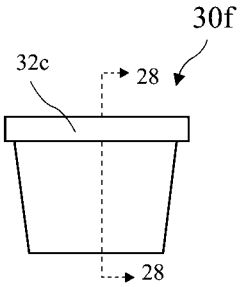
FIG. 27 is a side view of a sixth coffee holder according to the present invention.
Figure 28:
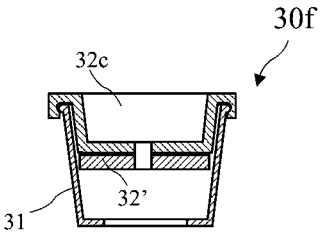
FIG. 28 is a cross-sectional side view of the sixth coffee holder according to the present invention taken along line 28-28 of FIG. 27.

A side view of a sixth coffee holder 30*f* according to the present invention is shown in FIG. 27 and a cross-sectional side view of the sixth coffee holder 30*f* taken along line 28-28 of FIG. 27 is shown in FIG. 28. The sixth coffee holder 30*f* includes the holder body 31 and a third holder lid 32*c*. The third holder lid 32*c* includes a recessed portion 32' which reaches into the interior of the sixth coffee holder 30*f*. The recessed portion 32' is preferably a solid resilient material.

Figure 29A:
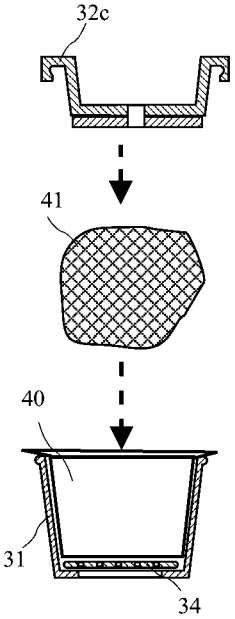
FIG. 29A is a cross-sectional side view of the sixth coffee holder according to the present invention taken along line 28-28 of FIG. 27 showing the portion of coffee above the coffee holder, and the holder lid ready to attach to the holder body, according to the present invention.
Figure 29B:
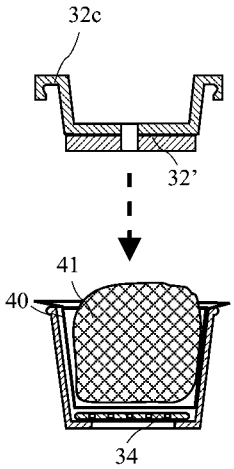
FIG. 29B is a cross-sectional side view of the sixth coffee holder according to the present invention taken along line 28-28 of FIG. 27 showing the portion of coffee in the coffee holder, and the holder lid ready to attach to the holder body, according to the present invention.
Figure 29C:
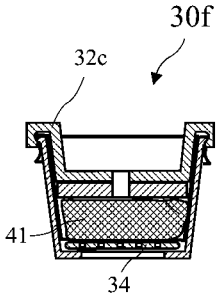
FIG. 29C is a cross-sectional side view of the sixth coffee holder according to the present invention taken along line 28-28 of FIG. 27 showing the portion of coffee in the coffee holder, and the holder lid attached and tamping the coffee, according to the present invention.

A cross-sectional side view of the sixth coffee holder 30*f* taken along line 28-28 of FIG. 27 showing the sixth coffee holder 30*f* with a portion of coffee 41, and the holder lid 32*c*, above the holder body 31, is shown in FIG. 29A. A cross-sectional side view of the sixth coffee holder 30*f* taken along line 28-28 of FIG. 27 showing the coffee holder with the portion of coffee 41 in the coffee holder, and the holder lid 32*c* above the holder body 31, is shown in FIG. 29B. A cross-sectional side view of the sixth coffee holder 30*f* along line 28-28 of FIG. 27 showing the sixth coffee holder 30*f* with the portion of coffee 41 in the coffee holder 30*e*, and the holder lid 32*e* attached to the holder base 31 is shown in FIG. 26D. A cushion 32' tamps the coffee 41 to provide a tamped coffee when the holder lid 32*e* is attached to the holder base 31. The cushion 32' is preferably made from a resilient material to cushion the tamping of the loose coffee.

Figure 30:
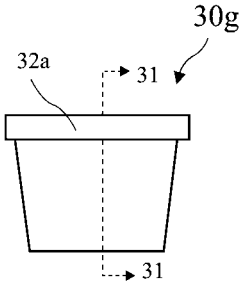
FIG. 30 is a side view of a seventh coffee holder according to the present invention.
Figure 31:
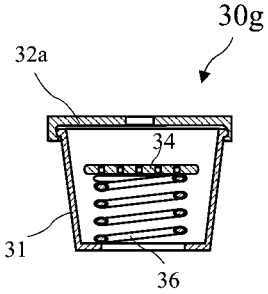
FIG. 31 is a cross-sectional side view of the seventh coffee holder according to the present invention taken along line 31-31 of FIG. 30.
Figure 32A:
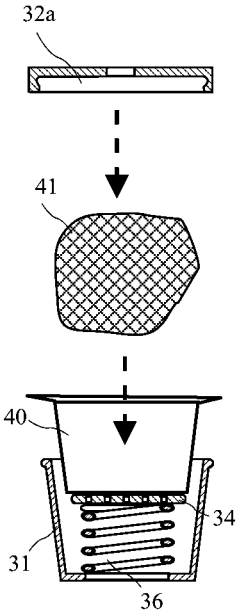
FIG. 32A is a cross-sectional side view of the seventh coffee holder according to the present invention taken along line 31-31 of FIG. 30 showing the portion of coffee above the coffee holder, and the holder lid ready to attach to the holder body, according to the present invention.
Figure 32B:
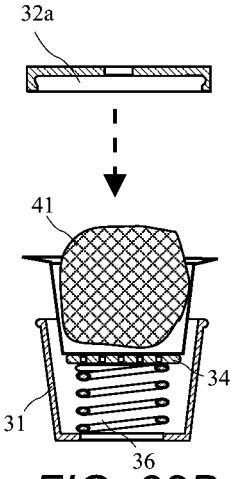
FIG. 32B is a cross-sectional side view of the seventh coffee holder according to the present invention taken along line 31-31 of FIG. 30 showing the portion of coffee in the coffee holder, and the holder lid ready to attach to the holder body. according to the present invention.
Figure 32C:
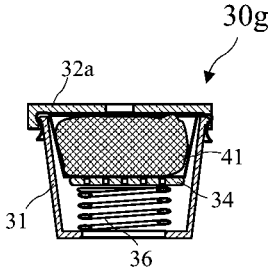
FIG. 32C is a cross-sectional side view of the seventh coffee holder according to the present invention taken along line 31-31 of FIG. 30 showing the portion of coffee in the coffee holder, and the holder lid attached to the holder body and the coffee tamped between the bottom tamper and spring and the holder lid, according to the present invention.

A side view of a seventh coffee holder 30*g* according to the present invention is shown in FIG. 30 and a cross-sectional side view of the seventh coffee holder 30*g* taken along line 31-31 of FIG. 30 is shown in FIG. 31. The seventh coffee holder 30*g* includes the holder body 31, the holder lid 32*b*, the tamping spring 36, and the bottom tamper 34 inside the holder base 31.

A cross-sectional side view of the seventh coffee holder 30*g* taken along line 31-31 of FIG. 30 showing the seventh coffee holder 30*g* with a portion of coffee 41 and the holder lid 32*a* above the holder body 31, and with the bottom tamper 34 and tamping spring 36 inside the holder base 31, is shown in FIG. 26A. A cross-sectional side view of the seventh coffee holder 30*g* taken along line 31-31 of FIG. 30 showing the coffee holder with the portion of coffee 41 in the filter paper 40 in the holder base 31 resting on the bottom tamper 34 supported by the tamper spring 36, and the holder lid 32*a* above the holder body 31, is shown in FIG. 26B. A cross-sectional side view of the seventh coffee holder 30*g* taken along line 31-31 of FIG. 30 showing the seventh coffee holder 30*g* with the portion of coffee 41 in the coffee holder 30*e*, and the holder lid 32*a* attached to the holder base 31, is shown in FIG. 26D. The tamper spring 36 and bottom tamper 34 tamp the coffee 41 upward against the tamper lid 32*a* to provide a tamped coffee when the holder lid 32*a* is attached to the holder base 31.

Figure 33:
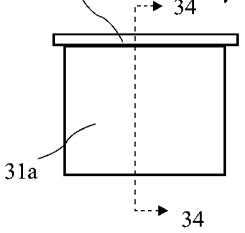
FIG. 33 is a side view of an eighth coffee holder according to the present invention.
Figure 34A:
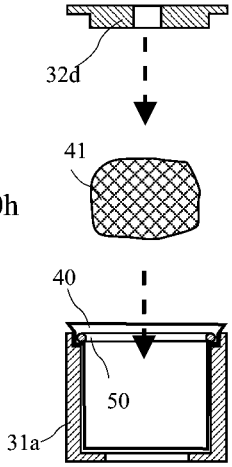
FIG. 34A is a cross-sectional side view of the eighth coffee holder taken along line 34-34 of FIG. 33 showing a portion of coffee for placing inside the coffee holder and the holder lid with an insertable portion and an O-Ring inside the coffee holder for sealing according to the present invention.
Figure 34B:
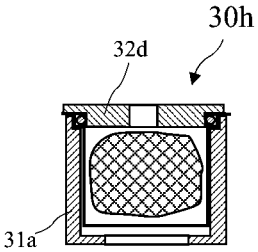
FIG. 34B is a cross-sectional side view of the eighth coffee holder taken along line 34-34 of FIG. 33 showing the portion of coffee inside the coffee holder and the holder lid with the insertable portion inserted into the coffee holder and cooperating with the O-Ring inside the coffee holder for sealing.

A side view of an eighth coffee holder 30*h* according to the present invention is shown in FIG. 33, a cross-sectional side view of the eighth coffee holder 30*h* taken along line 34-34 of FIG. 33 showing a portion of coffee 41 for placing inside the coffee holder and a fourth holder lid 32*d* with an insertable portion and an O-Ring 50 inside the coffee holder for sealing is shown in FIG. 34A, and a cross-sectional side view of the eighth coffee holder taken along line 34-34 of FIG. 33 showing the portion of coffee 41 inside the coffee holder 30*h* and the holder lid 32*d* with the insertable portion inserted into the coffee holder base 31*a* is shown in FIG. 34B. The filter paper 40 extends up above the O-ring 50 and the O-Ring 50 cooperates with the holder lid 32*d* to sandwich the top edge of the filter paper 40 for sealing the filter paper 40 to reduce or prevent the coffee 41 from escaping when the flow of hot water is provided to the coffee holder 30*h*. The holder base 31*a* is preferably cylindrical but may also be conical in shape.

Figure 35:
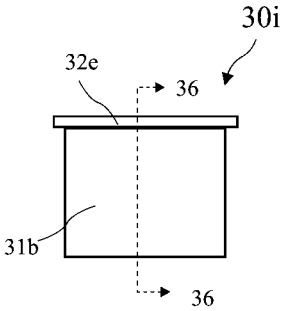
FIG. 35 is a side view of a ninth coffee holder according to the present invention.
Figure 36A:
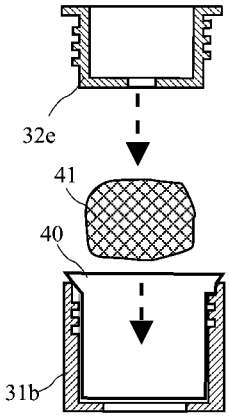
FIG. 36A is a cross-sectional side view of the ninth coffee holder taken along line 36-36 of FIG. 35 showing a portion of coffee for placing inside the coffee holder and a holder lid with a threaded portion for screwing inside the holder body for sealing according to the present invention.
Figure 36B:
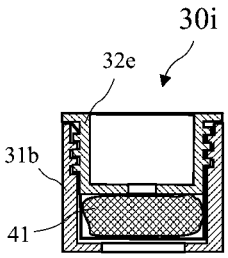
FIG. 36B is a cross-sectional side view of the ninth coffee holder taken along line 36-36 of FIG. 35 showing the portion of coffee inside the coffee holder and a holder lid with the threaded portion screwed into the holder body and tamping the coffee according to the present invention.

A side view of a ninth coffee holder 30*i* according to the present invention is shown in FIG. 35, a cross-sectional side view of the ninth coffee holder 30*i* taken along line 36-36 of FIG. 35 showing a portion of coffee 41 for placing inside the coffee holder and a fifth holder lid 32*e* with a threaded portion for screwing inside the holder base 31*b* for sealing is shown in FIG. 36A, and a cross-sectional side view of the ninth coffee holder 30*i* taken along line 36-36 of FIG. 35 showing the portion of coffee 41 inside the coffee holder and the holder lid 32*e* with the threaded portion screwed into the coffee holder and tamping the coffee 41 is shown in FIG. 36B. The threads both provide tamping and sealing the coffee to reduce or prevent the coffee 41 from escaping when the flow of hot water is provided to the coffee holder 30*h*. The holder base 31*b* is preferably cylindrical to facilitate having internal threads, and at least the threaded portion is preferably cylindrical.

Figures 37A, 37B, 37C:
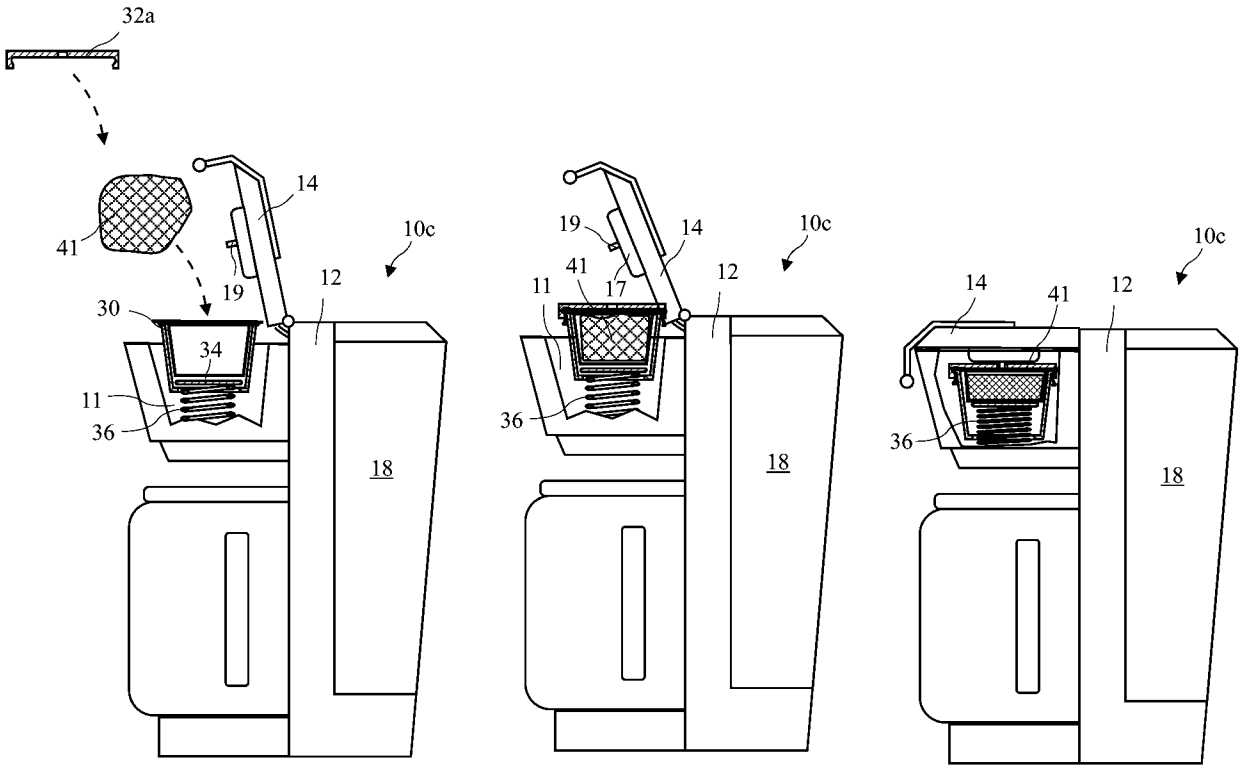
FIG. 37A shows a third coffee maker having a coffee holder for receiving a portion of coffee and tamping spring according to the present invention for tamping the coffee when the coffee maker lid is closed.
FIG. 37B shows the third coffee maker with the coffee holder holding the portion of coffee and the tamping spring under the coffee holder according to the present invention for tamping the coffee when the coffee maker lid is closed.
FIG. 37C shows the third coffee maker with the coffee holder holding the portion of tamped coffee with the coffee maker lid closed for tamping the coffee according to the present invention.

A third coffee maker 10*c* having a coffee holder 30 according to the present invention for receiving a portion of coffee and a tamping spring 36 for tamping the coffee is shown in FIG. 37A, the third coffee maker 10*c* with the coffee holder 30 holding the portion of coffee 41 is shown in FIG. 37B, and the third coffee maker 10*c* with the coffee holder 30 holding the portion of coffee 41 with the coffee maker lid 14 closed for tamping the coffee 41 is shown in FIG. 37C. When the lid 14 is closed, the pad 17 pushes the coffee holder 30 down and the tamping spring 36 enters the bottom of the coffee holder 30 to tamp the coffee 41. While attaching the lid 32*a* to the holder 30 is preferred in order to prevent coffee grounds from escaping the holder 30, the coffee maker 10*c* may also be used without the lid 32*a* and the pad 17 may serve to seal the coffee 41 in the holder 30. In this instance, the coffee maker lid 14 serves as a coffee holder lid.

Figure 38A:
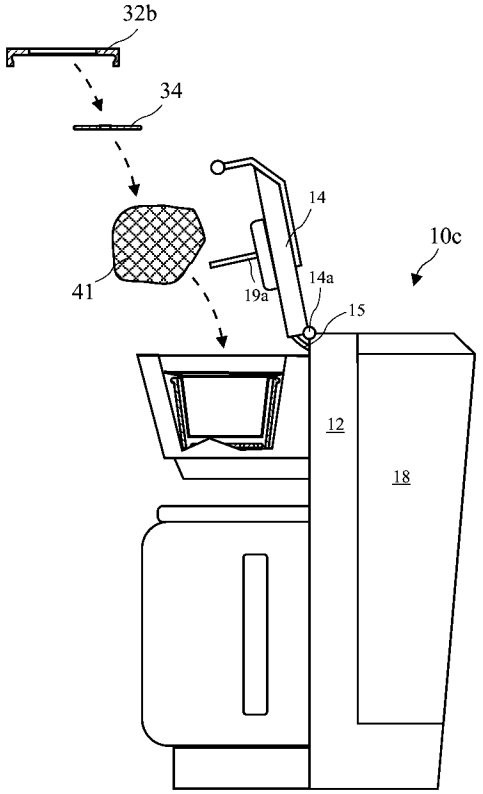
FIG. 38A shows a third coffee maker having a coffee holder for receiving a portion of coffee and tamping spring attached to the coffee maker lid according to the present invention for tamping the coffee when the coffee maker lid is closed.
Figure 38B:
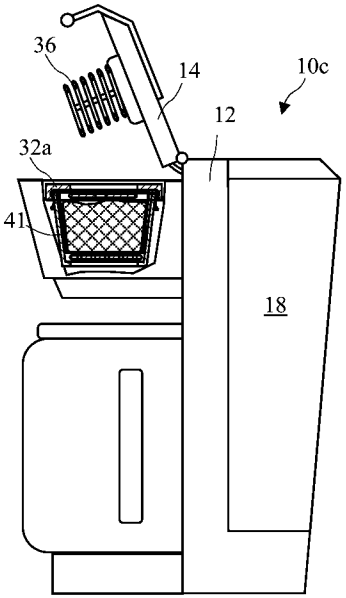
FIG. 38B shows the third coffee maker with the coffee holder holding the portion of untamped coffee according to the present invention for tamping the coffee when the coffee maker lid is closed.
Figure 38C:
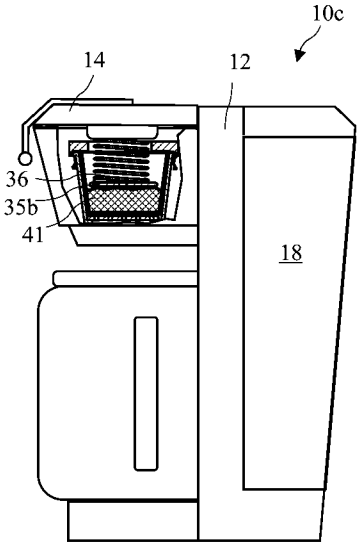
FIG. 38C shows the third coffee maker with the coffee holder holding the portion of tamped coffee with the coffee maker lid closed to push the tamping spring into the coffee holder for tamping the coffee according to the present invention.

A third coffee maker 10*c* having a coffee holder for receiving a portion of coffee and tamping spring 36 attached to the coffee maker lid 14 according to the present invention for tamping the coffee 41 when the coffee maker lid 14 is closed is shown in FIG. 38A, the third coffee maker with the coffee holder 30 holding the portion of coffee 41 is shown in FIG. 38B, and the third coffee maker 10*c* with the coffee holder 30 holding the portion of coffee 41 with the coffee maker lid 14 closed to push the tamping spring 36 into the coffee holder 30 for tamping the coffee 41 is shown in FIG. 38C.

Figures 39A, 39B, 39C:
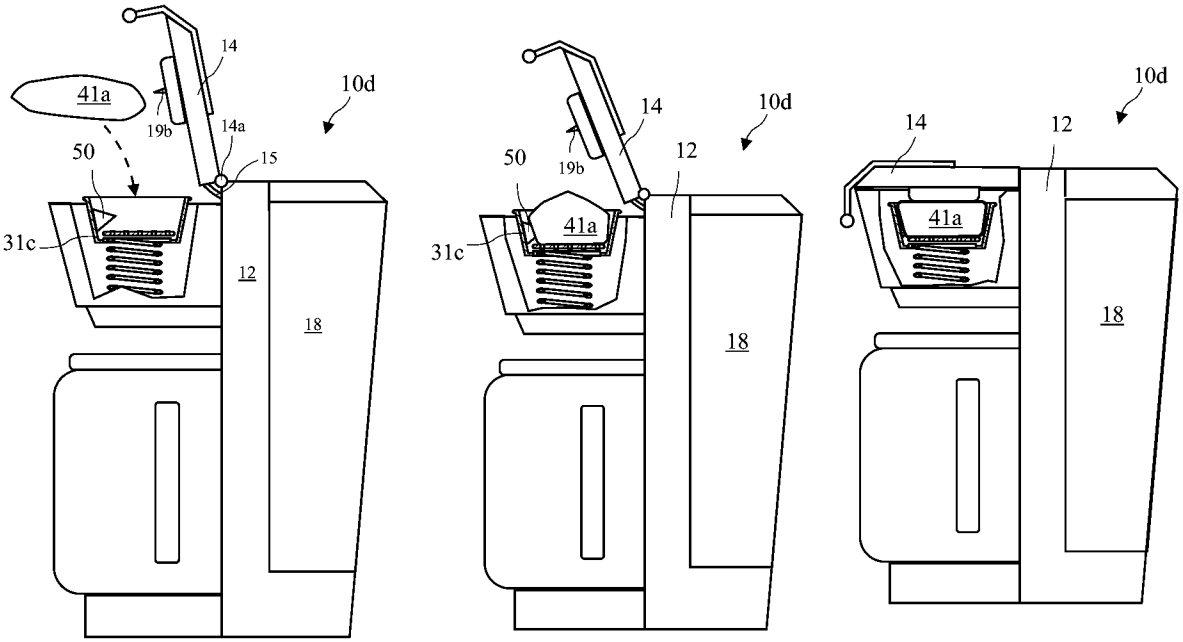
FIG. 39A shows a fourth coffee maker having a coffee holder for receiving a packet containing untamped coffee, a knife for cutting the packet open, and tamping spring attached to the coffee maker lid according to the present invention for tamping the coffee when the coffee maker lid is closed.
FIG. 39B shows the fourth coffee maker with the coffee holder holding the packet of untamped coffee according to the present invention for tamping the coffee when the coffee maker lid is closed.
FIG. 39C shows the fourth coffee maker with the coffee holder holding the packet of tamped coffee with the coffee maker lid closed to push the tamping spring into the coffee holder for tamping the coffee according to the present invention.

A fourth coffee maker 10*d* having a third holder base 31*c* for receiving a packet 41*a* containing untamped coffee, a knife 50 for cutting the packet 41*a* open, and tamping spring 36 under the holder base 31*c* according to the present invention for tamping the coffee when the coffee maker lid is closed is shown in FIG. 39A, the fourth coffee maker 10*d* with the holder base 31*c* holding the packet 41*a* of untamped coffee is shown in FIG. 39B, and fourth coffee maker with the holder base 31*c* holding the packet of tamped coffee 41*c* with the coffee maker lid 14 closed to push the holder base down over the tamping spring 36 for tamping the coffee is shown in FIG. 39C. The coffee maker 10*d* includes a somewhat pointed nozzle 19*a* to puncture the packet 41*a* to provide the flow of hot water to the tamped coffee in the packet 41*a*. Known coffee packets include internal filters to allow a flow of hot water through the packet to make the coffee drink while preventing coffee grounds from escaping. The cut in the packet 41*a* made by the knife 50 allows the coffee drink to escape from the packet while filter material in the packet 41*a* prevent coffee grounds from escaping. The tamping spring 36 may also be attached to the lid 14 as in FIGS. 38A-38C.

The packet 41*a* may be an air tight pod containing coffee in filter paper and positioning the knife on the side of the holder base 31*c* results in less likelihood of the knife 50 cutting the filter paper. The packet 41*a* is preferably air tight to maintain coffee freshness and may be plastic, metal foil, or other air tight material which is sufficiently flexible to allow the coffee contained in the packet 41*a* to be tamped. Alternatively, the knife 50 may be eliminated when the packet 41*a* is configured to burst under pressure to expose the coffee, for example, when the coffee maker tamps the coffee, the packet 41*a* also bursts. In one embodiment, filter paper 41 is inserted into the holder base 31*c* without the knife 50, and the packet 41*a* bursts during compacting to release the coffee into the filter paper.

Known coffee makers use a sealed cup or capsule having a somewhat ridged cup with a foil cover. Such cups might be compressible and used in the coffee maker 10*d*, however, a similar cup or capsule having a less ridged cup which may be compressed in the coffee maker 10*d* are more suitable for use in the coffee maker 10*d* to allow tamping of the coffee contained in the cup or capsule.

Figure 40A:
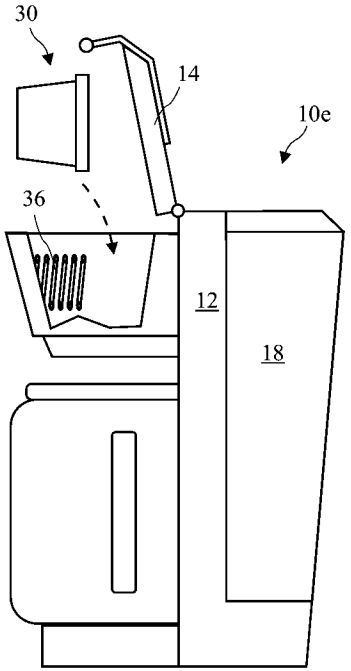
FIG. 40A shows a fifth coffee maker accepting a horizontal coffee holder and tamping spring residing horizontally in a coffee holder cavity according to the present invention for tamping the coffee when the coffee maker lid is closed.
Figure 40B:
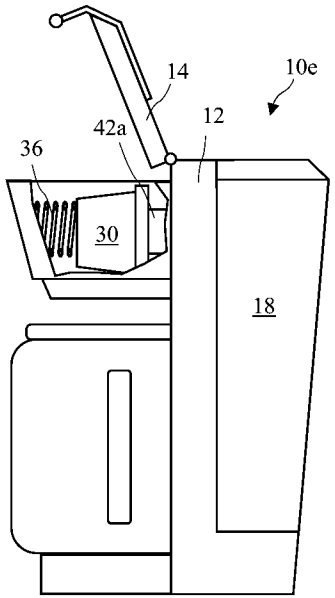
FIG. 40B shows the fifth coffee maker with the coffee holder residing horizontally in the coffee holder cavity according to the present invention for tamping the coffee when the coffee maker lid is closed.
Figure 40C:
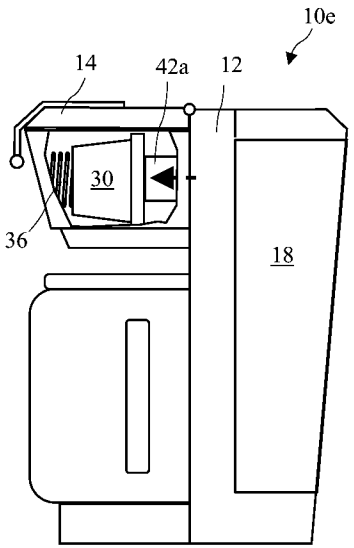
FIG. 40C shows the fifth coffee maker with the coffee holder residing horizontally in the coffee holder cavity with the coffee maker lid closed and the coffee holder pushed against the tamping spring for tamping the coffee, according to the present invention.

A fifth coffee maker 10*e* for horizontally receiving the coffee holder 30 is shown in FIG. 40A, the fifth coffee maker with the coffee holder 30 residing in the coffee maker is shown in FIG. 40B, and the fifth coffee maker with the coffee maker lid 14 closed and the tamping spring 36 entering the coffee holder 30 for tamping the coffee 41 is shown in FIG. 40C. The fifth coffee maker 10*d* may alternatively include a tamping spring entering the coffee holder top, or a resilient solid block pushed into the coffee holder 30 to tamp the coffee. Preferably, a horizontal ram 42*a* is actuated when the lid 14 is closed and pushed the coffee holder 30 against the spring 36 to tamp the coffee. The horizontal ram 42*a* may actuated by an electrical solenoid, by pressure, or by mechanical levers connected to the lid 14. The fifth coffee maker 10*e* may further include any of the features described above for other embodiments of the coffee maker according to the present invention and may be configured to use any of the coffee holders described above according to the present invention.

Figure 41B:
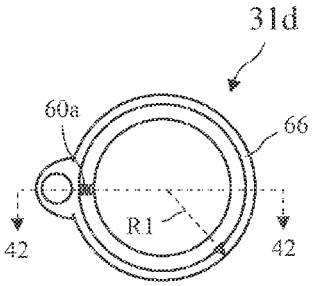
FIG. 41B shows a top view of the fourth coffee holder base configured to reside horizontally in a coffee maker, according to the present invention.
Figure 42:
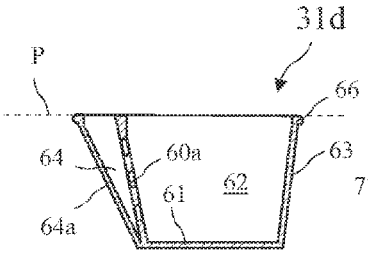
FIG. 42 shows a cross-sectional view of the fourth coffee holder base configured to reside horizontally in a coffee maker, according to the present invention taken along line 42-42 of FIG. 41B.
Figure 41A:
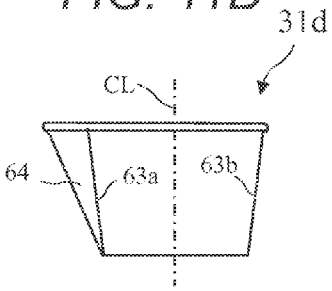
FIG. 41A shows a side view of a fourth embodiment of a coffee holder base configured to reside horizontally in a coffee maker, according to the present invention.
Figure 41C:
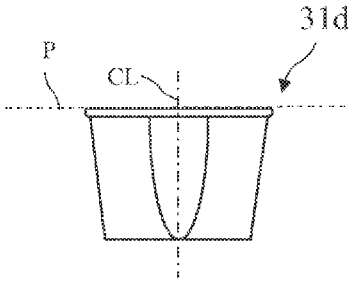
FIG. 41C shows a front view of the fourth coffee holder base configured to reside horizontally in a coffee maker, according to the present invention.

FIG. 41A shows a side view of a fourth embodiment of a coffee holder base 31*d* configured to reside horizontally in a coffee maker, FIG. 41B shows a top view of the coffee holder base 31*d*, FIG. 41C shows a front view of the coffee holder base 31*d*, and FIG. 42 shows a cross-sectional view of the coffee holder base 31*d* residing vertically taken along line 42-42 of FIG. 41B. The coffee holder base 31*d* includes a solid (having no holes) floor 61, an interior 62 for receiving brewing material, walls 63 rising from the floor 61, and a rim 66 at the top of the walls 63. A passage 64 is formed on the side of the coffee holder 31*d*. The passage 64 is in fluid communication with the interior 62 through ports 60*a* allowing brewed liquid in the interior 62 to pass into the passage 64. The rim 66 has a radius R1 sized to fit into a coffee maker, for example, about one inch. The radius R1 for a known coffee maker is not greater than about two inches, and is preferably about two inches.

Figure 43B:
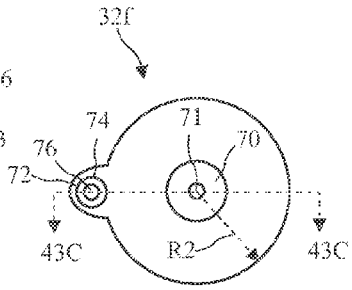
FIG. 43B shows a top view of the sixth coffee holder lid for the fourth coffee holder base configured to reside horizontally in a coffee maker, according to the present invention.
Figure 43A:
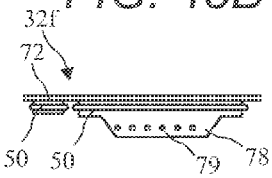
FIG. 43A shows a side view of a sixth embodiment of a coffee holder lid for the fourth coffee holder configured to reside horizontally in a coffee maker, according to the present invention.
Figure 43C:
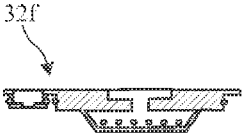
FIG. 43C is a cross-sectional view of the sixth embodiment of a coffee holder lid for the fourth coffee holder base configured to reside horizontally in a coffee maker, taken along line 43C-43C of FIG. 43B, according to the present invention.

FIG. 43A shows a side view of a first embodiment of a coffee holder lid (or cover) 32*f* for the coffee holder base 31*d*, FIG. 43B shows a top view of the holder lid 32*f*, and FIG. 43C is a cross-sectional view of the coffee holder lid 32*f* taken along line 43C-43C of FIG. 43B. The coffee holder lid 32*f* is attachable to the coffee holder base 31*d*. preferably through an interference fit. and may include O-rings 50 to facilitate the interference fit. The coffee holder lid 32*f* has a mostly circular perimeter and a protrusion 72 for mating to the coffee maker, and may include recesses 70 and 74 to aid in sealing to the coffee maker, and inlet port 71 for receiving heated water preferably through an injection nozzle 19 (see FIG. 2A) and an outlet port 76 for carrying brewed drink from the coffee holder base 31d. The coffee holder lid 32*f* may further include a diffuser portion 78 having diffuser ports 79 for distributing heated water into brewing material in the interior 62 and restricting brewing material from contacting the injection nozzle 19. The diffuser ports may vary in size and/or number, with smaller and/or fewer ports adjacent to the protrusion 72, to provide more heated water to the higher areas of the interior 62 when the coffee holder base 31*d* resides on it's side in a coffee maker. The holder lid 32*f* has a radius R2 sized to seat the cartridge in a coffee maker. The radius R2 for a known coffee maker is about 1.2 inches.

Figure 44A:
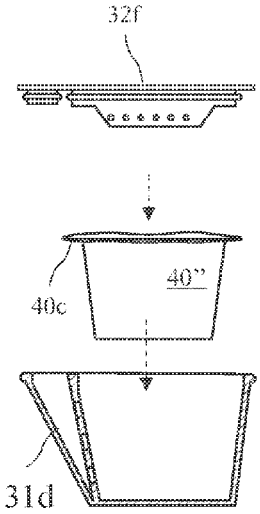
FIG. 44A shows a cross-sectional view of the fourth coffee holder base, the sixth coffee holder lid, and a filter paper cup containing brewing material, according to the present invention.
Figure 44B:
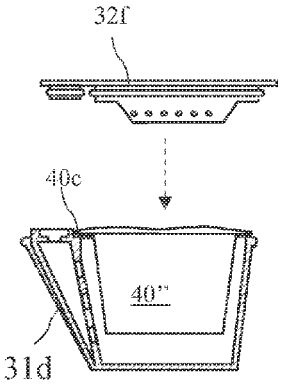
FIG. 44B shows a cross-sectional view of the fourth coffee holder base, the sixth coffee holder lid, and a filter paper cup containing brewing material residing in the coffee holder, according to the present invention.
Figure 44C:
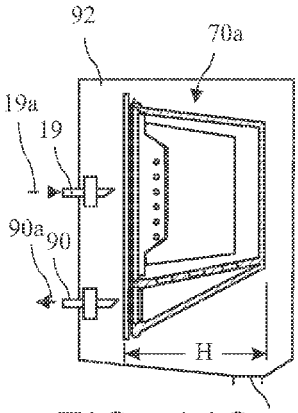
FIG. 44C shows a cross-sectional view of an assembled cartridge configured to reside horizontally in a coffee maker, according to the present invention.
Figure 44D:
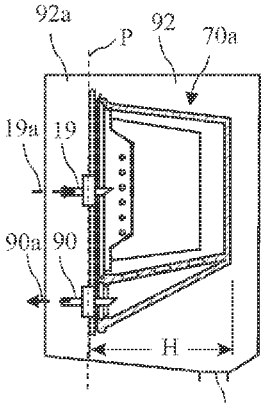
FIG. 44D shows a cross-sectional view of an assembled cartridge residing horizontally in a coffee maker with two nozzles engaging the cartridge, according to the present invention.

FIG. 44A shows a cross-sectional view of the coffee holder base 31*d*, coffee holder lid 32*f*, and a pre-pack filter paper cup 40" containing brewing material, FIG. 44B shows a cross-sectional view of the coffee holder base 31*d*, coffee holder lid 32*f*, and the pre-pack filter paper cup 40" containing brewing material residing in the coffee holder base 31*d*, FIG. 44C shows a cross-sectional view of an assembled cartridge 70*a* configured to reside horizontally in a brewing chamber 92 of the coffee machine configured to receive a single serving brewing cartridge, and FIG. 44D shows the nozzles 19 and 90 in an interfacing side 92*a* of the brewing chamber 92 engaging the horizontally residing cartridge 70*a*. The pre-pack filter paper cup 40" is purchased in a pre-packaged form containing brewing material. The cartridge 70*a* may be similarly prepared using a filter paper cup 40 or 40' (see FIGS. 7A and 7C) which may be purchased in an empty state, and brewing material may be added to the filter paper cup 40 or 40' before or after seating the filter paper cup 40 or 40' in the coffee holder 32*j*. When the pre-pack filter paper cup 40" or the filter paper cup 40' having a lid 40*d* is used, the filter paper cup 40' or 40" may be pierced by the nozzle 19 entering through the inlet port 71 to receive a low of heated water 19*a* and by an extraction nozzle 90 through the outlet port 76 to release a generally horizontal flow of brewed drink 90*a* into the coffee machine. The brewing chamber 92 further includes a drain 94 for any brewed drink which escapes the assembled cartridge 70*a*, and such escaping brewed drink is combined with the flow of brewed drink 90*a* for release to a cup or the like. In one embodiment, the cartridge 70*a* is configured for use in a coffee maker sold under the KEURIG trademark accepting disposable single serving coffee cartridges sold under the trademark VUE. The cartridge height H may vary between, for example, between 1.3 and 1.8 inches.

The filter paper rim 40*c* of the pre-pack filter paper cup 40" is seen to rest on the rim 66 of the coffee holder base 31*d* in FIG. 44B, and is sandwiched between the rim 66 and the holder lid 32*f* of the assembled cartridge 70*a* in FIG. 44C. Such sandwiching provides support for the walls 40*a* of the pre-pack filter paper cup 40". Further, after use, coffee holder lid may be detached from the coffee holder base, and the coffee holder base and/or coffee holder lid may be recycled or reused, and the filter paper cup and used brewing material may be discarded or recycled. The assembled cartridge 70*a* is configured to reside generally horizontally in the brewing chamber 92, and may reside at a small angle from horizontal, as long as the coffee holder base 31*d* provides a slope to allow the brewed drink to flow from the interior 62 into the passage 64 and out of the assembled cartridge 70*a*.

Figure 45B:
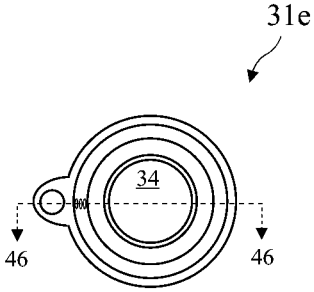
FIG. 45B shows a top view of the fifth coffee holder base configured to reside horizontally in a coffee maker, according to the present invention.
Figure 46:
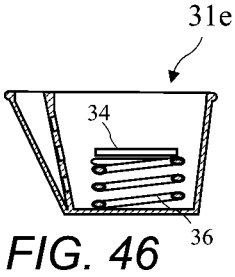
FIG. 46 shows a cross-sectional view of the fifth coffee holder base showing a tamper in the coffee holder, configured to reside horizontally in a coffee maker, according to the present invention taken along line 46-46 of FIG. 45B.
Figure 45A:
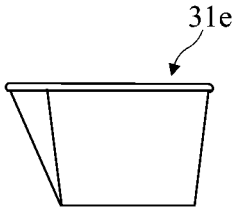
FIG. 45A shows a side view of a fifth embodiment of a coffee holder base configured to reside horizontally in a coffee maker, according to the present invention.
Figure 45C:
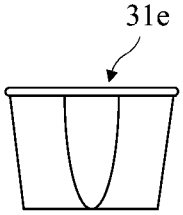
FIG. 45C shows a front view of the fifth coffee holder base configured to reside horizontally in a coffee maker according to the present invention.

FIG. 45A shows a side view of a fifth embodiment of a coffee holder base 31*e*, FIG. 45B shows a top view of the coffee holder base 31*e*, FIG. 45C shows a front view of the eleventh coffee holder base 31*e*, and FIG. 46 shows a cross-sectional view of the eleventh coffee holder base 31*e*, showing a tamper 34 in the coffee holder base 31*e*, taken along line 46-46 of FIG. 45B. The coffee holder base 31*e* includes the tamper 34 supported by tamping spring 36. The coffee holder base 31*e* otherwise may include some or all of the features of the coffee holder base 31*d*.

Figure 47B:
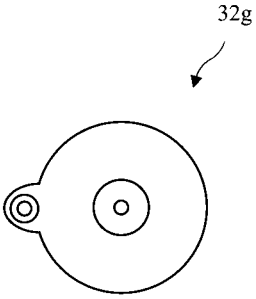
FIG. 47B shows a top view of the seventh coffee holder lid for the fifth coffee holder base configured to reside horizontally in a coffee maker, according to the present invention.
Figure 47A:
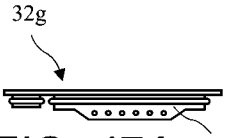
FIG. 47A shows a side view of a seventh embodiment of a coffee holder lid for the fifth coffee holder base configured to reside horizontally in a coffee maker, according to the present invention.

FIG. 47A shows a side view of a coffee holder lid 32*g* for the coffee holder base 31*e* and FIG. 47B shows a top view of the coffee holder lid 32*g*. The coffee holder lid 32*g* may include a shallow diffuser 78' allowing additional volume for the tamper 34 and tamping spring 36 inside the holder base 31*e*, and otherwise may include some or all of the features of the holder lid 32*f*.

Figure 48A:
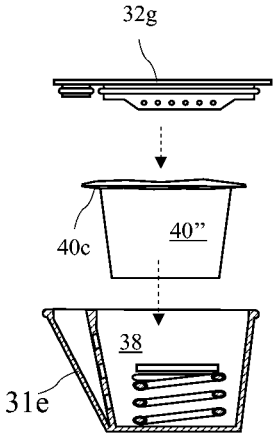
FIG. 48A shows a cross-sectional view of the fifth coffee holder base, the seventh coffee holder lid, and a filter paper cup containing brewing material, according to the present invention.
Figure 48B:
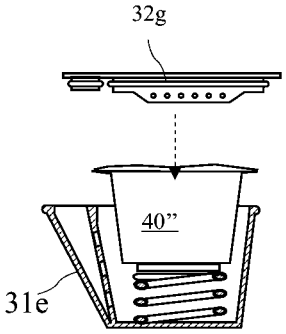
FIG. 48B shows a cross-sectional view of the fifth coffee holder base, the seventh coffee holder lid, and a filter paper cup containing brewing material residing in the coffee holder, according to the present invention.
Figure 48C:
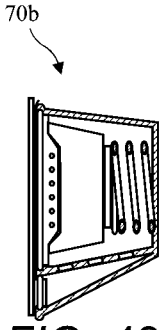
FIG. 48C shows a cross-sectional view of an assembled cartridge configured to reside horizontally in a coffee maker, according to the present invention.

FIG. 48A shows a cross-sectional view of the coffee holder base 31*e*, coffee holder lid 32*g*, and pre-pack filter paper cup 40", FIG. 48B shows a cross-sectional view of the coffee holder base 31*e*, coffee holder lid 32*g*, and the pre-pack filter paper cup 40" residing in the coffee holder base 31*e*, and FIG. 48C shows a cross-sectional view of an assembled cartridge 70*b* configured to reside horizontally in a coffee maker. The cartridge 70*b* provides tamping to provide better extraction of brewed drink, and otherwise may include some or all of the features of the cartridge 70*a*. In another embodiment the tamper 34 and tamping spring 36 may reside in the coffee maker (see FIG. 22A) and enter the coffee holder base through a passage in the floor of the coffee holder base. In still another embodiment the tamper 34 and tamping spring 36 may reside in the coffee maker (see FIG. 18B) and enter the coffee holder base through a passage in the coffee holder cover.

Figure 49B:
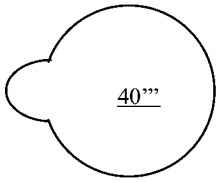
FIG. 49B shows a top view of the third embodiment of the filter paper cup containing brewing material configured for a horizontal residing coffee holder.
Figure 49A:
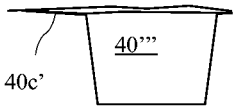
FIG. 49A shows a side view of a third embodiment of a filter paper cup containing brewing material configured for a horizontal residing coffee holder.

FIG. 49A shows a side view of a second embodiment of a pre-pack filter paper cup 40'" containing brewing material and FIG. 49B shows a top view of the pre-pack filter paper cup 40'". The pre-pack filter paper cup 40'" includes an extended rim 40*c'* extending over the passage 64 of the coffee holders 31*d* and 31*e*.

Figure 50B:
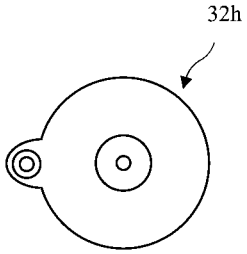
FIG. 50B shows a top view of the eighth lid for a horizontal residing coffee holder base.
Figure 50A:
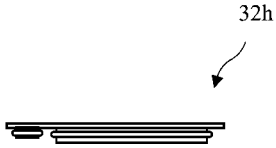
FIG. 50A shows a side view of an eighth lid for a horizontal residing coffee holder base.

FIG. 50A shows a side view of a third coffee holder lid 32*h* for a horizontal residing coffee holder and FIG. 50B shows a top view of the coffee holder lid 32*h*. The holder lid 32*h* does not include a diffuser but otherwise may include some or all of the features of the holder lid 32*g*.

Figure 51A:
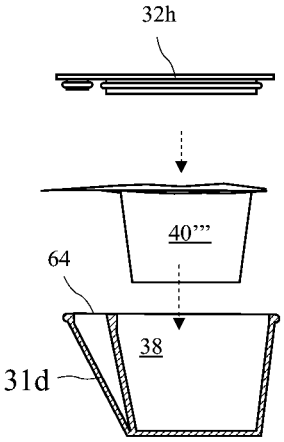
FIG. 51A shows a cross-sectional view of the coffee holder base, the eighth coffee holder lid, and the third filter paper cup containing brewing material, according to the present invention.
Figure 51B:
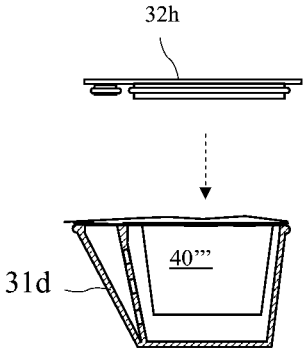
FIG. 51B shows a cross-sectional view of the coffee holder base, the eighth coffee holder lid, and the third filter paper cup containing brewing material residing in the coffee holder, according to the present invention.
Figure 51C:
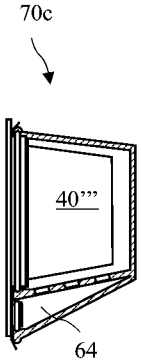
FIG. 51C shows a cross-sectional view of an assembled cartridge configured to reside horizontally in a coffee maker, according to the present invention.

FIG. 51A shows a cross-sectional view of the coffee holder base 31*d*, coffee holder lid 32*h*, and the pre-pack filter paper cup 40'" containing brewing material, FIG. 51B shows a cross-sectional view of the coffee holder base 31*d*, the coffee holder lid 32*h*, and the pre-pack filter paper cup 40'" residing in the coffee holder base 31*d*, and FIG. 51C shows a cross-sectional view of an assembled cartridge 70*c* configured to reside horizontally in a coffee maker. The extended rim 40*a'* is sandwiched between the rim 66 of the coffee holder base 31*d* and the coffee holder lid 32*h*, including over the passage 64.

Figure 52B:
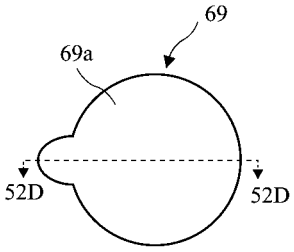
FIG. 52A shows a side view of a fourth embodiment of a filter paper cup containing brewing material configured for a horizontal residing coffee holder.
Figure 52D:
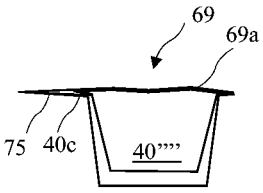
Figure 52A:
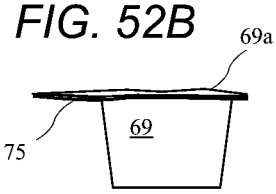
Figure 52C:
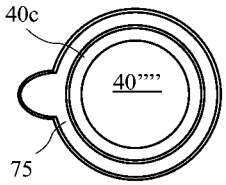

FIG. 52A shows a side view of a pre-pack brewing material 69, FIG. 52B shows a top view of the pre-pack brewing material 69, and FIG. 52C shows a bottom view of the pre-pack brewing material 69. The pre-pack brewing material 69 contains a filter paper cup 40"" containing brewing material and includes adhesive 73 (see FIG. 55A) residing on a bottom surface 83 (see FIG. 55A) of a rim of a cover 69*a*. The cover 69*a* may be filter paper, or be a peal off protective foil, plastic foil, metal foil, or the like. The adhesive 73 is covered by a peel-off strip 75 which is removed before use. The rim 40*c* of the filter paper cup 40"" is held against the cover 69*a*. Alternatively, a consumer fillable filter paper cup may also include the adhesive 73 and peel-off strip 75 for fixing to a coffee holder.

Figure 53B:
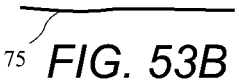
Figure 53A:
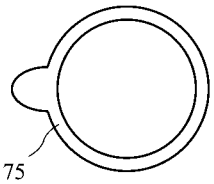

FIG. 53A shows a side view of the peel-off strip 75 and FIG. 53B shows a top view of the peel-off strip 75.

Figure 54B:
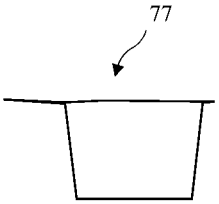
Figure 54A:
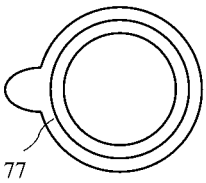

FIG. 54A shows a side view of a peel-off packaging 77 and FIG. 54B shows a top view of the peel-off packaging 77. The peel-off packaging 77 both covers the adhesive 73 and the walls and base of the pre-pack filter paper cup 40"", thereby protecting the pre-pack filter paper cup 40"" from moisture and potential damage. The peel-off packaging 77 may be a foil, plastic foil, metal foil, or similar material. After the peel-off packaging 77 is removed, the cover 69*a* may be punctured during use.

Figure 55A:
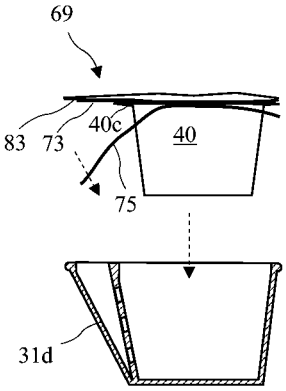
Figure 55B:
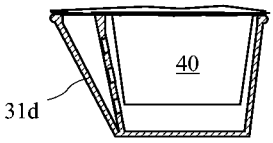
Figure 55C:
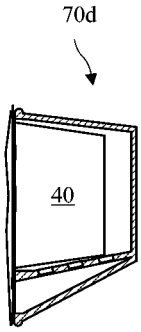

FIG. 55A shows a cross-sectional view of the coffee holder base 31*d* and the pre-pack filter paper cup 40"" before assembly, FIG. 55B shows a cross-sectional view of the coffee holder base 31*d* and the pre-pack filter paper cup 40"" just after assembly, and FIG. 55C shows a cross-sectional view of an assembled cartridge 70*d* configured to reside horizontally in a coffee maker. A rim 81 of the filter paper cup 40"" is exposed when the peel-off strip 75 or the peel-off packaging 77 is peeled away from the filter paper cup 40"". The pre-pack filter paper cup 40"" may similarly be used with a coffee holder base 31*e* having a light tamping spring 36.

Figure 56:
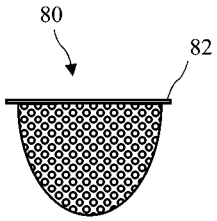

FIG. 56 shows a rimmed concave mesh brewing material holder (e.g., filter) 80 having a rim 82. The rimmed mesh brewing material holder 80 may be made from any suitable mesh material, for example, metal mesh, plastic mesh, cloth mesh, or the like, which is suitable for filtering a brewed liquid and capturing a brewing material. The rim 82 is a pliable material conforming to hard surfaces.

FIG. 57A shows a cross-sectional view of the coffee holder base 31*d*, the rimmed mesh brewing material holder 80, brewing material 41, and the holder lid 32*f* before assembly into a cartridge, FIG. 57B shows a cross-sectional view of the mesh brewing material holder 80 residing in the coffee holder base 31*d*, FIG. 57C shows a cross-sectional view of the brewing material 41 residing in the mesh brewing material holder 80 residing in the coffee holder base 31*d*, and FIG. 57D shows a cross-sectional view of an assembled cartridge 70*e* configured to reside horizontally in a coffee maker. The rim 82 is sandwiched between the coffee holder base 31*d* and the holder cover 32*f* to hold the mesh brewing material holder 80 in place.

FIG. 58A shows a side view of a sixth embodiment of a coffee holder base 31*f*. FIG. 58B shows a top view of the coffee holder base 31*f*, FIG. 58C shows a front view of the coffee holder base 31*f*, and FIG. 59 shows a cross-sectional view of the coffee holder base 31*f* taken along line 59-59 of FIG. 58B. The coffee holder base 31*f* includes a mesh window 84 in the coffee holder wall separating the interior 62 from the passage 64. The mesh window 84 may be a metal mesh, a cloth mesh, a plastic mesh, or any mesh suitable to allow a beverage to pass while capturing brewing material.

FIG. 60A shows a cross-sectional view of the coffee holder base 31*f*, the coffee holder lid 32*f*, and brewing material 41, FIG. 60B shows a cross-sectional view of the coffee holder base 31*f*, coffee holder lid 32*f*, and brewing material 41 residing in the coffee holder base 31*f*, and FIG. 60C shows a cross-sectional view of an assembled cartridge 70*f* configured to reside horizontally in a coffee maker.

FIG. 61A shows a side view of a seventh embodiment of a coffee holder base 31*g* configured to reside horizontally in a coffee maker, FIG. 61B shows a top view of the coffee holder base 31*g*, FIG. 61C shows a front view of the coffee holder base 31*g*, and FIG. 62 shows a cross-sectional view of the coffee holder base 31*g* taken along line 42-42 of FIG. 41B. The coffee holder base 31*g* includes a raised outlet 86 for mating with the brewing chamber 92 (see FIG. 44C) which replaces corresponding features of, for example, the coffee holder lid 32*f* (see FIGS. 43A and 43B). The raised outlet 86 preferably includes the recess 74 and outlet port 76 of the coffee holder lid 32*f* (see FIGS. 43B and 43C). The coffee holder 31*g* may include some or all of the additional features of the coffee holder 31*d*.

FIG. 63A shows a side view of a ninth embodiment of a coffee holder lid 32*i*, according to the present invention, for the coffee holder base 31*g*, FIG. 63B shows a top view of the coffee holder lid 32*i*, FIG. 63C is a cross-sectional view of the coffee holder lid 32*i* taken along line 43C-43C of FIG. 43B. The coffee holder lid 32*i* defines a generally round perimeter 88 and does not include the recess 74 and outlet port 76 residing on the protrusion 72 of the coffee holder lid 32*f*. Other than the protrusion 72, recess 74, and outlet port 76, the coffee holder lid 32*i* may include some or all of the features of the coffee holder 30*f*.

FIG. 64A shows a cross-sectional view of the thirteenth coffee holder 31*g*, the coffee holder lid 32*i*, and a filter paper cup 40' containing brewing material, FIG. 64B shows a cross-sectional view of the coffee holder 31*g*, the coffee holder lid 32*i*, and the filter paper cup 40' containing brewing material residing in the coffee holder base 31*g*, and FIG. 64C shows a cross-sectional view of an assembled cartridge 70*g* configured to reside horizontally in a coffee maker with the rim 40*c* of the filter paper cup 40' sandwiched between the coffee holder base 31*g* and coffee holder lid 32*i*.

While the assembled cartridge 70*g* is described containing the filter paper cup 40' containing brewing material, in another embodiment, the filter paper cup 40' may be replaced by the mesh brewing material holder 80 (see FIG. 56). Further, another embodiment of the coffee holder base 31*g* may include the mesh window 84 of the coffee holder base 31*f* (see FIGS. 58B and 59) and brewing material 41 may be placed directly into the coffee holder base 31*f* as seen in FIGS. 60A-60C.

FIG. 65A shows a side view of an eighth embodiment of a coffee holder base 31*h* configured to reside horizontally in a coffee maker, according to the present invention, FIG. 65B shows a top view of the coffee holder base 31*h*, FIG. 65C shows a front view of the coffee holder base 31*h*, and FIG. 66 shows a cross-sectional view of the coffee holder base 31*h* taken along line 66-66 of FIG. 65B. The coffee holder base 31*h* includes a generally cylindrical passage 64 receiving brewed drink from the interior 62 of the coffee holder base 31*h*. The coffee holder base 31*h* otherwise may include some or all of the feature of the coffee holder base 31*d* (see FIGS. 41A, 41B, 41C, and 42).

FIG. 67A shows a side view of an ninth embodiment of a coffee holder base 31*i* configured to reside horizontally in a coffee maker, according to the present invention, FIG. 67B shows a top view of the coffee holder base 31*i*, FIG. 67C shows a front view of the coffee holder base 31*i*, and FIG. 68 shows a cross-sectional view of the coffee holder base 31*i* taken along line 68-68 of FIG. 67B. The coffee holder base 31*i* includes a generally triangular passage 64 receiving brewed drink from the interior 62 of the coffee holder base 31*i*. The coffee holder base 31*i* otherwise may include some or all of the feature of the coffee holder base 31*d* (see FIGS. 41A, 41B, 41C, and 42).

It will be clear to those skilled in the art that the passage 64 may take on a variety of shapes, and a coffee holder base have any shaped passage receiving a flow of brewed drink from the interior of the coffee holder base, and providing that flow to the extraction nozzle 90 (see FIG. 44C) is intended to come within the scope of the present invention.

FIG. 69A shows a side view of an tenth embodiment of a coffee holder base 31*j* configured to reside horizontally in a coffee maker, FIG. 69B shows a top view of the coffee holder base 31*j*, FIG. 69C shows a front view of the coffee holder base 31*j*, and FIG. 66 shows a cross-sectional view of the coffee holder base 31*j* taken along line 70-70 of FIG. 69B. The coffee holder base 31*j* includes a shortened passage 64' and a port 60*a* allowing brewed drink to pass from the interior 62 of the coffee holder base 31*h* into the passage 64'.

FIG. 71 is a cross-sectional view of an assembled cartridge 70*h* including the fourteenth coffee holder configured to reside horizontally in a coffee maker. The cartridge 70*j* includes the coffee holder base 31*j* having the shortened passage 64', and otherwise may include some or all of the features of the cartridge 70*a*. Because the coffee holder base 31*j* is tapered, the brewed drink flow naturally towards the port 60*a* and into the shortened passage 64'.

The holder bases and covers described above are intended to interface with both the injection nozzle 19 and the extraction nozzle 90. While such interface provides the intended extraction of brewed material, experimentation has shown the unexpected result that adequate extraction of brewed beverage is achieved by merely allowing the cartridge to drain into the coffee make cavity provided for the cartridge. FIG. 72A shows a side view of an eleventh embodiment of a coffee holder base 31*k* configured to reside horizontally in a coffee maker, FIG. 72B shows a top view of the coffee holder base 31*k*, FIG. 72C shows a front view of the coffee holder base 31*k*, and FIG. 73 shows a cross-sectional view of the coffee holder base 31*k* taken along line 73-73 of FIG. 72B. The coffee holder base 31*k* has a generally frustoconical shape with a port 60*a* located near the top rim. The coffee holder base 31*k* may further include indicia 96 for positioning the coffee holder base 31*k* in the coffee maker. The indicia 96 is opposite the port 60*a* to facilitate positioning the coffee holder base 31*k* with the port 60*a* down for release of brewed beverage into the coffee maker cavity. The indicia 96 may be a raised bar, an arrow, a color, or any indicia suitable to indicating the position of the coffee holder base 31*k*.

FIG. 74 is a cross-sectional view of an assembled cartridge 70*i* including the eleventh coffee holder base 31*k* configured to reside horizontally in a coffee maker. While The cartridge 70*i* includes the coffee holder base 31*k* having the port 60*a'*, and otherwise may include some or all of the features of the cartridge 70*a*. The port 60*a* is open to allow a flow of brewed drink 94*a* to enter the brewing chamber 92 containing the cartridge 70*i* and to flow out through the drain 94. Advantageously, the drain 94 empties into a cup positioned to receive the brewed drink. Thus it is seen that the brewed drink is not required to flow from the cartridge 70*i* through the extraction nozzle 90 to fill a cup.

FIG. 75A shows a side view of a twelfth embodiment of a coffee holder base 31*l* configured to reside horizontally in a coffee maker, FIG. 75B shows a top view of the coffee holder base 31*l*, FIG. 75C shows a front view of the coffee holder base 31*l*, and FIG. 76 shows a cross-sectional view of the coffee holder base 31*l* taken along line 76-76 of FIG. 75B. The coffee holder base 31*l* includes an alignment feature 98 which aligns with a rounded notch in known coffee makers. The coffee holder base 31*l* may further include some or all of the features of the coffee holder base 31*k* and may be used in the same manner as the coffee holder base 31*k*.

While the present invention is described above as placing loose coffee in a coffee holder, the invention may also be practiced by placing prepackaged coffee, for example coffee pods, into the coffee holder. Further, while the coffee holder is generally described as having a snap on lid, a screw on lid may also be used, and in general the various elements of different embodiments described above may be mixed to provide new embodiments and such new embodiments are intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A single serving brewing cartridge for use in a coffee maker, the brewing cartridge comprising:

a holder base made from plastic and defining an interior and an exterior and comprising:

a holder floor under the interior;

holder walls reaching up from the holder floor and surrounding the interior; and a top edge of the holder walls above the interior, the top edge having a greater diameter than the holder floor;

a holder lid removably attached to cover the top edge of the holder base;

a filter residing in the interior of the holder base, the filter containing a single serving of brewing material, the filter including an outward reaching filter rim forming a closed perimeter around the top of the filter;

the entire filter rim sandwiched between the top edge of the holder walls and the holder lid and in direct contact with the top edge of the holder walls and the holder lid to hold the filter, the filter not otherwise held in position with respect to the holder base, wherein:

the brewing cartridge is configured to reside generally horizontally in a brewing chamber of the coffee maker;

the holder base has a vertical centerline CL;

a first portion and a second portion of the holder walls are generally symmetric opposed on opposite sides of the centerline CL;

a passage wall is defined protruding from the first portion of the holder walls, the passage wall closed at a bottom, reaching up to an outlet port proximal to the top edge of the holder walls; and a passage is created between the passage wall and the holder walls, the passage in fluid communication with the interior of the brewing cartridge through the filter allowing brewed drink to escape from the brewing cartridge, and in fluid communication with the coffee maker through the outlet port.

2. The single serving brewing cartridge of claim 1, wherein the passage releases the brewed drink generally horizontally into an extraction nozzle of the coffee maker.

3. The single serving brewing cartridge of claim 2, wherein the holder includes a permanently open injection port for receiving an injection nozzle.

4. The single serving brewing cartridge of claim 1, wherein the coffee holder lid includes an injection port for receiving an injection nozzle and an extraction port aligned with the passage in the holder base for receiving an extraction nozzle.

5. The single serving brewing cartridge of claim 1, wherein the passage releases the brewed drink into the brewing chamber.

6. The single serving brewing cartridge of claim 1, wherein the coffee holder lid is a press fit removable plastic holder lid.

7. The single serving brewing cartridge of claim 1, wherein;

the filter includes a foil cover covering a top of the filter; and the filter rim is adhered to a bottom surface of the foil cover.

8. The single serving brewing cartridge of claim 1, wherein the filter is a concave mesh filter having a pliable filter rim sandwiched between the coffee holder lid and the top edge of the holder walls.

9. A single serving brewing cartridge for use in a coffee maker, the brewing cartridge comprising:

a holder base made from plastic and configured to reside generally horizontally in a coffee maker, the holder base comprising:

a holder interior;

a holder floor under the interior;

a vertical centerline CL;

holder walls reaching up from the holder floor and surrounding the interior and generally radially symmetric about the centerline CL;

a top edge of the holder walls above the interior, the top edge having a greater diameter than the holder floor;

a passage wall protruding from the holder walls, the passage wall closed at a bottom and reaching up to an outlet port proximal to the top edge of the holder walls; and a passage between the passage wall and the holder interior, the passage in fluid communication with the holder interior allowing brewed drink to escape from the holder interior, and in fluid communication with the coffee maker through the outlet port;

a holder lid removably attached to the holder base, the holder lid comprising:

a generally round portion centered above the interior of the holder base configured for receiving an injection nozzle of the coffee maker; and a protrusion extending from the generally round portion and aligned with the passage of the holder base, the protrusion configured for receiving an extraction nozzle of the coffee maker to provide a flow of brewed drink to the coffee maker;

a filter paper cup residing in the interior of holder base and containing a single serving of brewing material, the filter paper cup comprising:

a filter paper base; and filter paper walls reaching up from the filter paper base; and an outward reaching closed perimeter filter paper rim at the top of the filter paper walls, the entire closed perimeter filter paper rim sandwiched between the holder base and the holder lid and sealing against the holder lid and not adhered to the holder base.

10. The single serving brewing cartridge of claim 1, wherein the filter is released from the holder base whenever the holder lid is detached from the holder base.

11. A single serving brewing cartridge rotated after filling with brewing material to reside on its side in the brewing chamber of a coffee maker, the brewing cartridge comprising:

a holder base made from plastic, and as described before rotating the cartridge, comprising:

a vertical centerline CL;

a horizontal holder floor perpendicular to the centerline CL, the centerline CL intersecting the center of the center of the horizontal floor, and the horizontal floor having a floor perimeter;

holder walls reaching up from the floor perimeter;

a horizontal holder rim at the top of the walls, the holder rim defining a plane generally perpendicular to the centerline CL, and the holder rim larger than the holder floor;

a holder interior defined inside the holder walls;

a holder exterior outside the holder walls;

a passage wall protruding from the holder walls, the passage wall closed at a bottom and reaching up to an outlet port proximal to the holder rim; and a passage between the passage wall and the holder interior forming a sump in fluid communication with the holder interior allowing brewed drink to escape from the holder interior, and in fluid communication with the coffee maker through the outlet port and configured to align with an extraction needle of the coffee maker after rotating the brewing cartridge;

a plastic holder lid interfacing with an infusion nozzle residing generally horizontally in an interfacing side of the brewing chamber, a generally horizontal flow of liquid through the infusion nozzle into the brewing chamber; the lid closeable to a closed position on the holder base, and the lid com prising:

a horizontal ceiling residing on the holder rim when the lid is closed to the closed position on the holder base the horizontal ceiling closing the holder interior;

a permanently open inlet port in the horizontal ceiling for receiving the infusion nozzle;

a downward extending portion reaching below the holder rim engaging the holder base to hold the holder lid in the closed position; and a filter residing in the holder base, the filter including an open top to receive the brewing material through the holder rim, the filter retaining the brewing material in the holder interior, and the filter is not adhered to the holder base.

12. The cartridge of claim 11, wherein the holder rim has a radius of about one inch.

13. The cartridge of claim 11, wherein the filter is a lift out reusable mesh filter.

14. The cartridge of claim 13, wherein the filter includes a rim at the top of the filter cooperating with the holder base to position the filter in the cartridge.

15. The cartridge of claim 11, wherein the holder floor is flat and provides a stable resting surface for filling the cartridge.

16. The cartridge of claim 11, wherein:

the holder lid covers the rim of the holder base leaving the passage uncovered; and the holder base includes an outlet at the top of the passage having an outlet port, the extraction nozzle entering the outlet port to receive the generally horizontal flow of brewed drink.

17. The cartridge of claim 11, wherein:

the holder lid covers the rim of the holder base and the passage; and the holder lid includes an outlet over the passage having an outlet port, the extraction nozzle entering the outlet port to receive the generally horizontal flow of brewed drink.

18. The cartridge of claim 11, wherein the downward extending smooth ring of the lid includes an O-ring forming the interference fit to the holder base.

19. The cartridge of claim 11, wherein the holder rim defines a circle generally perpendicular to the centerline CL, and the centerline CL intersecting the center of the circle defined by the horizontal holder rim.

20. A single serving brewing cartridge for use in a coffee maker, the brewing cartridge comprising:

a holder base made from plastic and defining an interior and an exterior and comprising:

a holder floor under the interior;

holder walls reaching up from the holder floor and surrounding the interior; and a top edge of the holder walls above the interior, the top edge having a greater perimeter than the holder floor;

a holder lid removably attached to the top edge of the holder walls;

a filter cooperating with the holder base, the filter retaining containing a single serving of brewing material in the holder base, the filter including a filter rim at a top of the filter; the filter held in position by cooperation of the filter rim, the holder base, and the holder lid and not otherwise held in position;

a passage wall outside the holder walls, the passage wall closed at a bottom and reaching up to an outlet port proximal to the top edge of the holder walls;

a passage between the passage wall and the holder interior, the passage in fluid communication with the holder interior allowing brewed drink to escape from the holder interior, and in fluid communication with the coffee maker through the outlet port; and a plane P defined by the top edge of the holder base, wherein the holder base is configured to allow an injection needle to come into fluid communication with the holder interior through the plane P for injection of liquid into the holder interior and into the brewing material, and to allow an extraction needle to come into fluid communication with the holder interior through the plane P and the outlet port to receive filtered brewed drink from the holder interior, without the extraction needle puncturing the filter, wherein the brewing cartridge is configured to reside generally horizontally in a brewing chamber of the coffee maker.

21. The single serving brewing cartridge of claim 11, further including a passage in the holder walls proximal to the top edge of the holder walls for releasing brewed material from holder base.

22. The single serving brewing cartridge of claim 11, wherein the holder lid is a foil holder lid.

* * * * *